US005606352A

United States Patent [19]

Yamakawa et al.

[11] Patent Number: 5,606,352

[45] Date of Patent: Feb. 25, 1997

[54] INK JET CARTRIDGE HAVING A CAN FILTERED INK SUPPLY MEMBER AND INK JET APPARATUS INCLUDING THE SAME

[75] Inventors: Koji Yamakawa; Takahisa Kawamura, both of Yokohama; Teruo Arashima, Kawasaki, all of Japan

[73] Assignee: Canon Kabushiki Kaisha, Tokyo, Japan

[21] Appl. No.: 165,507

[22] Filed: Dec. 13, 1993

Related U.S. Application Data

[62] Division of Ser. No. 897,746, Jun. 12, 1992, Pat. No. 5,341,161.

[30] Foreign Application Priority Data

Jun. 14, 1991 [JP] Japan ..... 3-143207
Jul. 15, 1991 [JP] Japan ..... 3-173960

[51] Int. Cl.[6] ..... B41J 2/05

[52] U.S. Cl. ..... 347/20; 347/85

[58] Field of Search ..... 347/20, 85, 56, 347/63, 65

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,775,871 | 10/1988 | Abe et al. | 346/140 R |
| 5,182,581 | 1/1993 | Kashimura et al. | 346/140 R |
| 5,221,936 | 6/1993 | Saito et al. | 346/140 R |

FOREIGN PATENT DOCUMENTS

| | | | |
|---|---|---|---|
| 419180 | 3/1991 | European Pat. Off. | 347/20 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 63-4954 | 1/1988 | Japan . | |
| 108050 | 4/1989 | Japan | 347/20 |
| 1645825 | 4/1991 | U.S.S.R. | 347/20 |

*Primary Examiner*—N. Le

[57] ABSTRACT

An ink jet cartridge includes a ceiling plate having an ink receiving port and a plurality of grooves as an ink passage, the grooves being communicated with the ink receiving port, a base plate having discharge energy generating elements for generating sufficient discharge energy to discharge ink, an ink supply member having an ink supply portion for connecting with the ink receiving port, the ink supply member for supplying ink from the ink supply portion to the ink receiving port, and a support substrate for supporting the base plate and for fixing the ink supply member. The ink supply member includes a cantilever portion having a top end, a root portion and a neck portion defined between the top end and the root portion, a width of the neck portion being gradually spread toward the root portion, the ink supply portion of the ink supply member being arranged at the top end of the cantilever portion. The ink supply portion is pressed on the ink receiving port and connected with the ink receiving port, and the ceiling plate is connected with the base plate to form the ink passage.

9 Claims, 14 Drawing Sheets

INK JET CARTRIDGE HAVING A CAN FILTERED INK SUPPLY MEMBER AND INK JET APPARATUS INCLUDING THE SAME

This application is a division of application Ser. No. 07/897,746, filed Jun. 12, 1992, U.S. Pat. No. 5,341,161.

BACKGROUND OF THE INVENTION

1. Field of the Invention

The present invention relates to an ink recorder including a sealing member adapted to sealably close therewith an opening portion of an ink supply passage extending from an ink storing section in which ink to be injected is stored and more particularly to an ink recorder serving as, e.g., an ink storing section, a recording head or an ink supply unit.

2. Description of the Prior Art

As is well known in the art, a number of tubes are used for an ink jet recording apparatus so as to reliably supply ink to an ink jet recording head via a predetermined supply passage. However, since it is difficult to turnably extend these tubes in the ink jet recording apparatus within the range defined by a comparatively short distance, a member molded of a synthetic resin and including a bent ink passage is sometimes used for the ink jet recording apparatus. In addition, since an ink supply passage formed in the foregoing member has a small cross-sectional area, an opening portion should be formed at a certain location on the ink supply passage so as to allow air to be vented to the outside therethrough during a molding operation.

Usually, however, since the opening portion is located at the intermediate position of the ink supply passage, it should sealably be closed by employing some means for the purpose of preventing ink from leaking through the opening portion. To this end, either the process of thermally fusing a sealing member such as a cover member or the like to the opening portion or the process of sealably closing the opening portion with an adhesive has been hitherto employed. The aforementioned kind of opening portion in the ink supply passage is formed on an ink tank serving as an ink accommodating section, a pump for supplying ink or a complicated ink conduction passage.

With a sealing step practiced using the conventional sealing member employable for the opening portion as mentioned above, however, there appear problems in that production becomes complicated, with each sealing member being produced with variations from product to product, or the sealing member inadequately adheres to the opening portion and ink is undesirably evaporated. In addition to the aforementioned problems, there is still another problem that a recording operation cannot stably be performed even though the sealing member is simple in structure. Furthermore, it is not desirable to take expensive steps to correct this point, particularly from the viewpoint of durability of the sealing member, because a small location to be assumed by the sealing member is undesirably enlarged in structure, resulting in appearance of a problem that the whole ink recorder cannot be designed and constructed with smaller dimensions. It goes without saying that leakage of ink through the opening portion induces fluctuation of pressure, causing a recording operation to be inconveniently performed. In addition, the interior of the ink jet recording apparatus is stained with the leaked ink.

It is desirable for the ink jet recording apparatus to properly cope with various environmental variations at all times. However, such measures have not heretofore been taken for the ink jet recording apparatus so as to allow the stably sealed state of the opening portion to be maintained at an inexpensive cost for a long time under any environmental condition.

SUMMARY OF THE INVENTION

The present invention has been made with the foregoing background in mind.

A first object of the present invention is to provide an ink recorder including a sealing mechanism which assures a stably sealed state in such a manner that an opening portion can sealably be closed with a sealing member at a low production cost on a production line without undesirable variations.

A second object of the present invention is to provide an ink recorder having excellent sealability and including a sealing mechanism which can satisfactorily cope with any environmental variation at all times.

According to the first aspect of the present invention, there is provided an ink recorder having an ink accommodating section in which ink is accommodated; an opening portion through which the interior of the ink accommodating section is communicated with the outside, the opening portion being disposed at a bent part located at the intermediate position of an ink supply passage molded of a synthetic resin by way of which ink is supplied from the ink accommodating section to an ink discharge section; a sealing member for sealably closing the opening portion therewith by fitting the sealing member into the opening portion so as to shut the interior of the ink accommodating section from the outside; at least the peripheral part of the opening portion being molded of a deformable synthetic resin; the sealing member being prepared in the form of a ball which makes it possible to sealably close the opening portion therewith by deformation of the peripheral part of the opening portion caused by press-fitting the sealing member into the opening portion; and a radius of curvature of the sealing member being dimensioned to be slightly larger than the smallest inner diameter of the opening portion.

The whole spherical sealing member may be prepared in the form of a metallic ball to be fitted into the opening portion.

In addition, the bent part may be located at the intersection where an ink supply pipe through which ink is taken from the ink accommodating section intersects an ink conduction pipe through which ink is conducted to the ink discharge section.

According to the present invention, since an adequate sealed state can be maintained by press-fitting the ball into the opening portion while the interior of the opening portion is deformed, it is possible to avoid having to prepare a complicated production step during which production variations are readily induced, as with a conventional step of coating the opening portion with an adhesive and then drying the latter and a conventional step of thermally fusing a sealing member to the opening portion. Consequently, a reliably sealed state can be obtained with the ink recorder of the present invention at all times.

According to the second aspect of the present invention, the ink recorder has an ink discharge section which has a ceiling plate having a plurality of discharge ports formed at one end thereof and a plurality of grooves communicated with the discharge ports while extending from one end of the discharge section toward the other end of the discharge section; a base plate connected to the ceiling plate to close the grooves in the ceiling plate therewith and including an element for generating energy to be utilized for ejecting ink from the discharge ports; an ink tank arranged on the surface on the opposite side relative to the grooves in the ceiling plate and including an ink passage through which ink is supplied into the grooves from the ink tank; the ink tank including reinforcing/fixing means for fixing the ink tank to an assembly of the ceiling plate and the base plate connected to each other; and at least a part of the ink tank being molded of a deformable material so as to allow the ink tank to be deformed to press an assembly of the ceiling plate and the base plate by the reinforcing/fixing means.

Usually, the ink tank is molded of a deformable material.

The ink tank includes pressing means for pressing the ceiling plate, and the pressing means is usually molded of a deformable material.

The reinforcing/fixing means may comprise at least a pair of foot portions extending from the ink tank in the direction of a thickness of an assembly of the ceiling plate and the base plate connected to each other and an engagement portion disposed at the foremost end of each of the foot portions for holding an assembly of the ceiling plate and the base plate while maintaining a predetermined thickness of the assembly.

The discharge energy generating element may be prepared in the form of an element for generating thermal energy for inducing film boiling in the ink to be ejected.

Other objects, features and advantages of the present invention will readily become apparent from reading of the following description which has been made in conjunction with the accompany drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
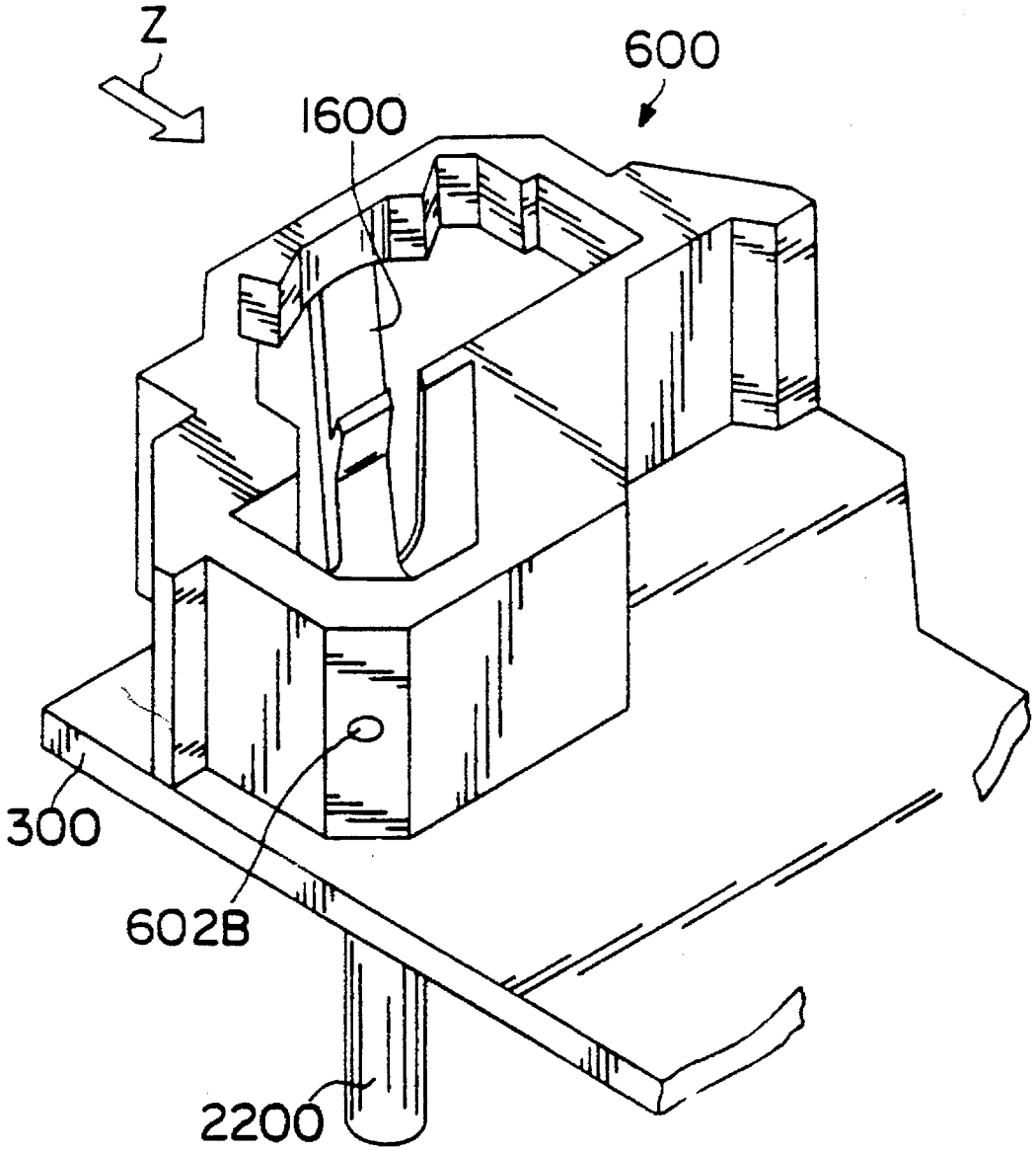
FIG. 1 is a fragmentary perspective view of an ink jet unit for a first embodiment of an ink recorder according to the present information.
Figure 2A:
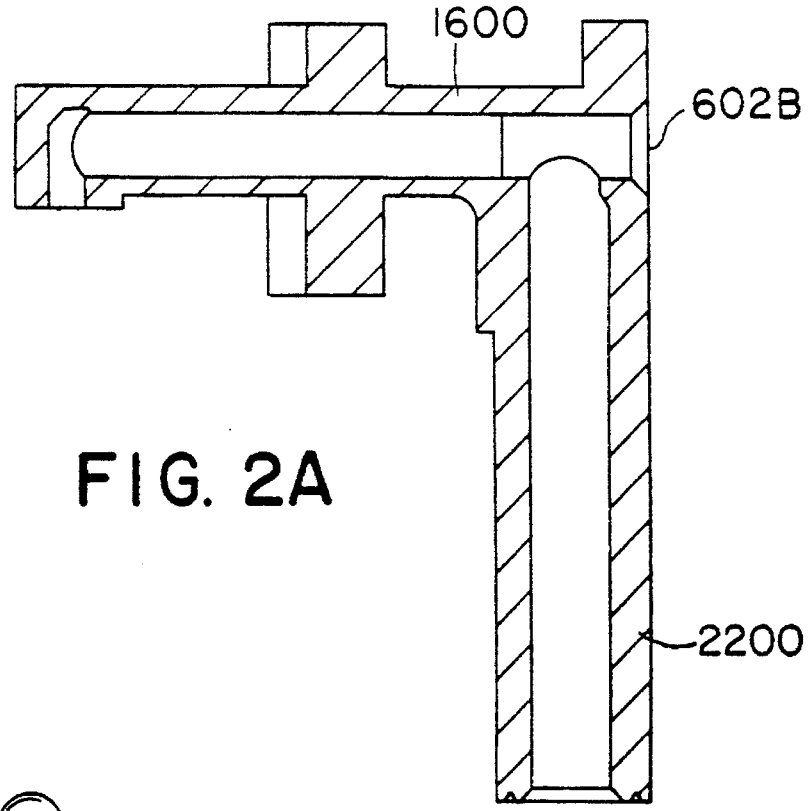
FIG. 2A is a sectional view showing an ink supply passage for the ink jet unit shown in FIG. 1.
Figure 2B:
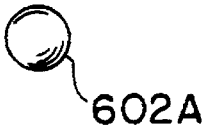
FIG. 2B is a perspective view showing a spherical sealing member to be press-fitted into an opening portion of the ink supply passage shown in FIG. 2A.
Figure 2C:
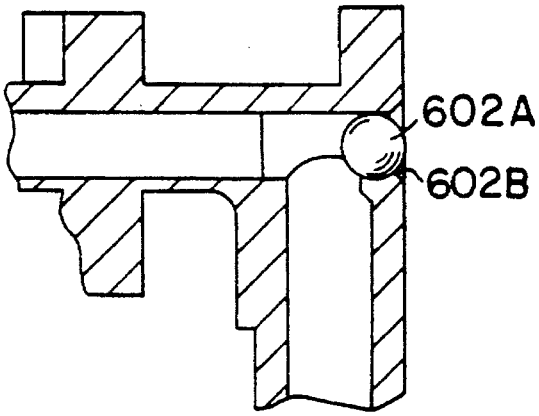
FIG. 2C is a fragmentary sectional view showing the ink supply passage shown in FIG. 2A, particularly showing that the spherical sealing member shown in FIG. 2B is press-fitted into the opening portion of the ink supply passage.

A first embodiment of an ink recorder according to the present invention will be described below with reference to FIG. 1 and FIGS. 2A to 2C. FIG. 2A is a fragmentary perspective view of the ink supply member 600 shown in FIG. 1, schematically illustrating an essential part of an ink supply passage in the ink supply member 600. The ink supply passage includes an opening portion 602B at the bent part thereof. FIG. 2B shows a ball 602A which serves as a sealing member when it is press-fitted into the opening portion 602B. FIG. 2C is a fragmentary sectional view of the ink supply passage in the ink supply member 600, particularly showing that the ball 602A is press-fitted into the opening portion 602B. In this embodiment, the substantially inverted L-shaped bent ink passage is composed of a stationary ink conduction pipe 1600 and an ink supply pipe 2200, and both the pipes 1600 and 2200 are integrally molded of a synthetic resin. It should be noted that the opening portion 602B serves as a venting hole through which gas is vented from a molding die (not shown) to the outside when the ink supply passage is integrally molded in the ink supply member 600 and serves as a hole for drawing a molded pin. The ball 602A to be press-fitted into the opening portion 602B is dimensioned to have a diameter slightly larger than the minimum inner diameter of the opening portion 602B. Thus, when the ball 602A is press-fitted into the opening portion 602B, it comes in close contact with the spherical surface of the opening portion 602B which has been formed by deformation of the synthetic resin. Consequently, a reliable seal is assured with the ball 602A.

According to the first embodiment of the present invention, the ball 602A serves mainly to sealably close the opening portion 602B therewith, and the bent part of the ink supply passage in the ink supply member 600 is constructed such that its cross-sectional area is reduced from the ink supply pipe 2200 toward the ink conduction pipe 1600 so as to assure that a capillary phenomenon appears between the ink conduction pipe 1600 and the ink supply pipe 2200. With such construction, employment of the spherical sealing member in the form of a ball 602A does not lead to undesirable disturbances in the ink flow but offers the advantage that the ink flow can be stabilized.

The ink recorder will be described in more detail below by offering several numerical examples. Referring to FIG. 2A, the lower end of the ink supply pipe 2200 comes in pressure contact with an absorbing body (not shown) in an ink tank so as to allow ink to be supplied to a recording head corresponding to a given ink consumption rate, and the ink supply pipe 2200 is dimensioned to have an inner diameter of 2.0 mm. The ink conduction pipe 1600 includes a supply pipe having an inner diameter of 1.0 mm on the opposite side relative to the ink supply pipe 2200 in order to supply ink to a common liquid chamber (not shown) in the recording head, and it is dimensioned to have an inner diameter of 1.5 mm across the full length thereof with an allowable tolerance from –0.08 mm or more to 0.05 mm or less. Thus, the opening portion 602B is dimensioned to have a minimum diameter of 1.5 mm with an allowable tolerance ranging from –0.08 mm or more to 0.05 mm or less. To make it easy for the spherical sealing member 602A to be press-fitted into the opening portion 602B, the front surface of the opening portion 602B is flared to have a diameter of 2.1 mm. Referring to FIG. 2B, the ball 602A to be press-fitted into the opening portion 602B is a solid metallic ball made of a stainless steel, an aluminum or a cast iron while having a diameter of 1.5 mm±0.02 mm. With such dimensions, when the ball 602A is press-fitted into the minimum diameter part of the opening portion 602B, the sealably closed state as shown in FIG. 2C is formed merely by slight interior deformation of the ink conduction pipe 1600 molded of a synthetic resin. Although it is preferable that the ball 602A has rigidity much more than that of the opening portion 602B, it may be molded of a synthetic resin. However, in consideration of vaporization of an ink associated with the hitherto known problem of vaporization of an adhesive, it is preferable that the ball 602A is made of a metallic material. In this case, since pressure contact is established between the metallic material and a synthetic resin, a comparatively stable sealed state can be maintained for a long time regardless of variations in the environment. The results obtained from a series of tests conducted for investigating resistibility against ink under conditions of 80° C. for a duration of two months revealed that a ball made of a stainless steel was particularly excellent.

Any press-fit mounting of the ball 602A in the opening portion 602B of the ink conduction pipe 1600 is satisfactory provided that reliable sealing is achieved with the ball 602A. In this embodiment, it is recommended that the whole ball 602A is fully embedded in the wall of the ink supply tube 2200. This is preferable because there is no possibility that the ball 602A can be dislocated due to contact with other structural members, and moreover, production condition can be established without fluctuation on a production line.

FIG. 1 is a perspective view of an ink supply member 600 as seen from the opening portion 602B side. Referring to FIG. 1, the opening portion 602B is formed on a part of the front plane. In case that the opening portion 602B is formed in that way, since the foregoing plane serves a contact plane where a sealing ball is press-fitted into the opening portion 602B of the ink supply member 600 by activating a pressing member (not shown), production stability can be improved further.

The present invention should not be limited only to the aforementioned embodiment but various changes or modifications may be made based on the technical concepts of the present invention. The present invention can be applied not only to the ink supply member but also to a sealing structure employable for an opening portion on an ink tank, an ink jet recording head or an assembly of the ink tank and the ink jet recording head.

According to the embodiment of the present invention, an adequate sealed state can reliably be maintained by press-fitting a ball into an opening portion merely by deformation of the interior of the opening portion. Thus, in contrast with a conventional step of coating an opening portion with an adhesive and then drying the latter and another conventional step of thermally fusing the opening portion to a sealing member, an ink recorder can be produced at an inexpensive cost without production fluctuation on a production line.

Next, a second embodiment of an ink recorder according to the present invention will be described in detail below with reference to FIG. 3 to FIG. 8 wherein the ink recorder includes an ink supply passage which is sealably closed with the spherical sealing member 602A as shown in FIG. 1 and FIGS. 2A to 2C. In FIGS. 3 to 8, an ink jet recording apparatus is exemplified as an ink recorder.

Figure 3:
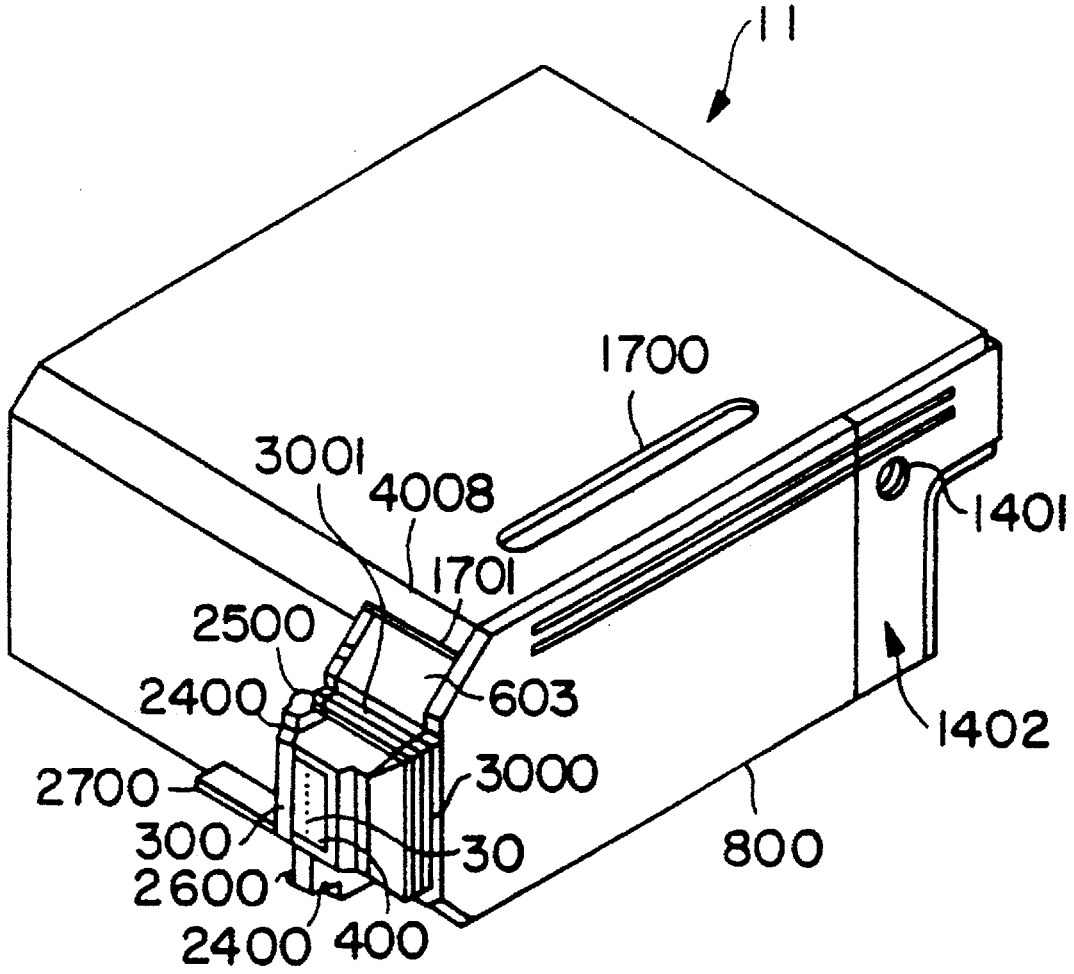
FIG. 3 is a perspective view showing an ink jet cartridge employable for a second embodiment of an ink recorder according to the present invention.
Figure 4:
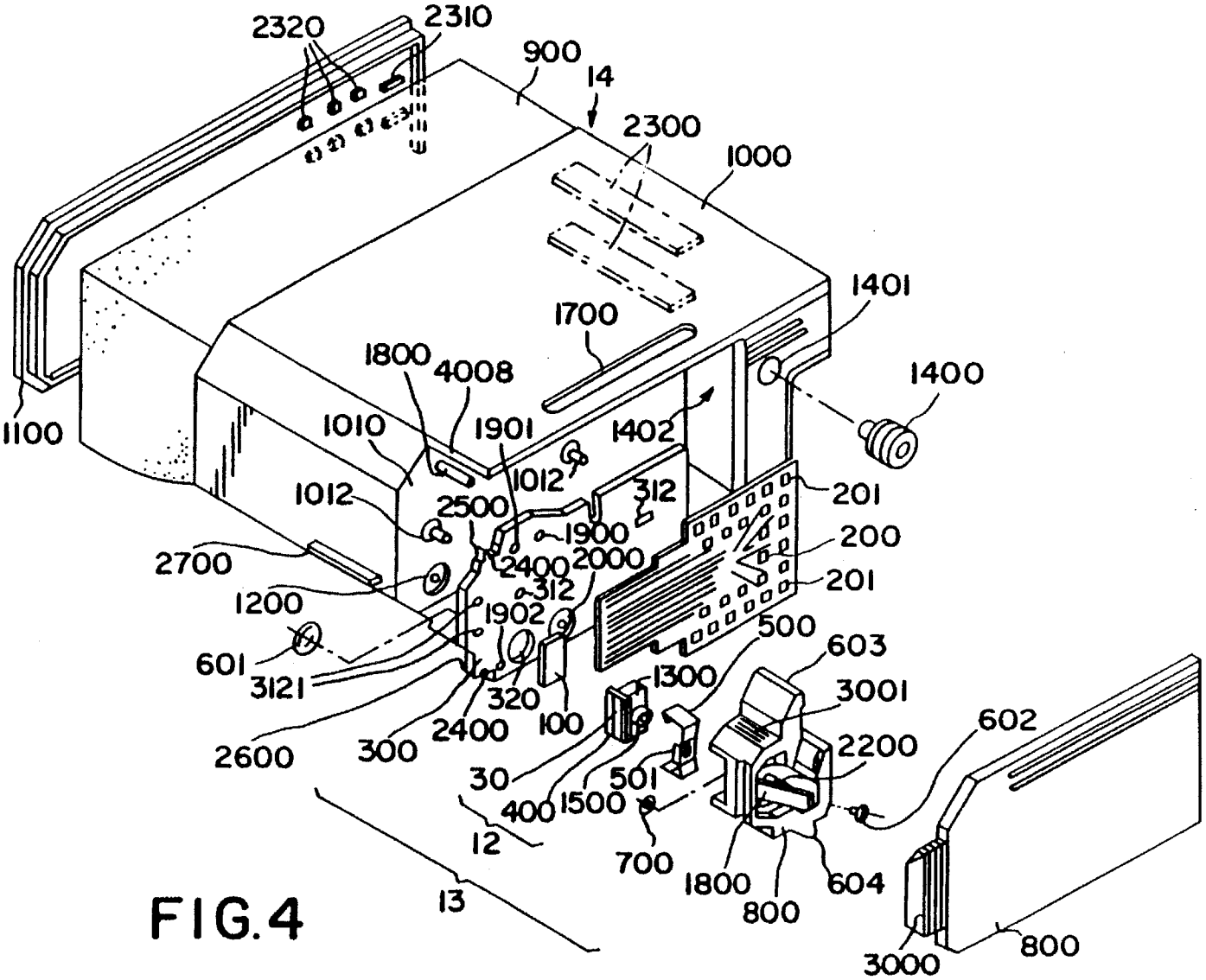
FIG. 4 is an exploded view showing the ink jet cartridge shown in FIG. 3, showing essential components constituting the ink jet cartridge.

FIG. 3 is a perspective view showing an ink jet cartridge 11 employable for the second embodiment of the ink jet recording apparatus according to the present invention, and FIG. 4 is a perspective view showing the ink jet cartridge 11, particularly showing essential components constituting the ink jet cartridge 11 in the disassembled state. The ink jet cartridge 11 will be described in more detail below mainly with reference to FIG. 4 wherein the essential components shown in these drawings are designated by the corresponding reference numerals.

The ink cartridge 11 includes an ink jet recording head 12 serving as a recording head with a plurality of discharge ports 30 integrally formed thereon, an ink jet unit 13 having electric lead wires leading to the ink jet recording head 12 and ink piping accommodated therein and an ink tank 14. In this embodiment, the ink cartridge 11 is constructed such that it has an ink receiving rate larger than that of the conventional one and the foremost end of the ink jet unit 13 is projected slightly from the front surface of the ink tank 14. The ink jet cartridge 11 is firmly supported by position determining means and electric contacts (to be described later) of a carriage 16 mounted on a main body 15 of the ink jet recording apparatus. In addition, the ink jet cartridge 11 is designed to be of the disposable type which makes it possible for it to be easily attached to and detached from the carriage 16 (see FIG. 7).

First, a structure of the ink jet head 12 will be described below.

Figure 5:
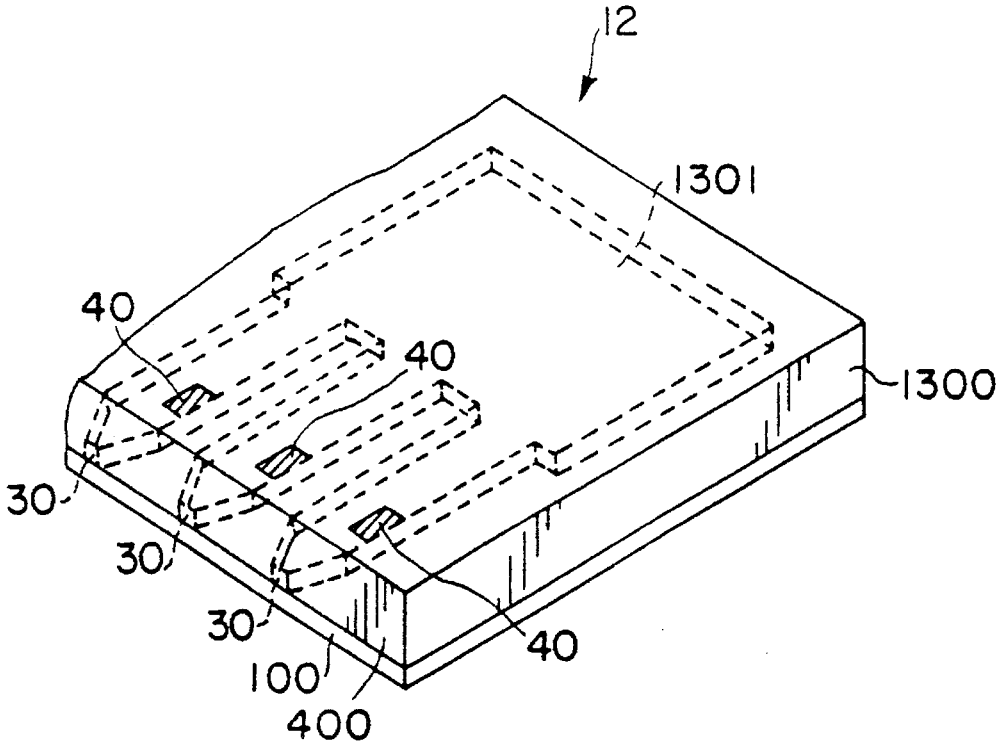
FIG. 5 is an enlarged perspective view showing an ink jet recording head employable with the ink jet cartridge shown in FIGS. 3 and 4.

As shown in FIG. 5, to assure that a recording liquid (ink) is ejected from a plurality of discharge ports 30, an electricity/heat converting substance 40 adapted to generate thermal energy with a certain magnitude of voltage applied thereto is disposed in each liquid passage. In response to a driving signal, each electricity/heat converting substance 40 is activated to generate thermal energy, causing the ink to boil, whereby a plurality of bubbles are formed in each liquid passage. As the bubbles grow, a series of ink droplets are ejected from each discharge port 30. Each electricity/heat converting substance 40 is placed on a heater board 100 composed of a silicon substrate, and the respective electricity/heat converting substances 40 are formed integral with aluminum wires (not shown) each serving for supplying electricity by employing a film forming technology. A grooved ceiling plate 1300 including partitions for separately forming a plurality of ink liquid passages and a common liquid chamber 1301 for temporarily receiving ink to be supplied to the respective ink liquid passages, on ink receiving port 1500 for conducting ink to the common liquid chamber 1301 from the ink tank 14 and an orifice plate 400 including a plurality of discharge ports 30 corresponding to the respective ink liquid passages are integrally formed. Polysulfone is preferably employable as a material for molding the aforementioned components but other molding resin materials such as polyethersulfone, polyphenyleneoxide, polypropylene and so on may be employed.

Next, a structure of the ink jet unit 13 will be described below.

The ink jet 13 includes a wiring board 200 of which one end is connected to the wiring portion of the heater board 100 and of which other end part includes a plurality of pads 201 corresponding to the electricity/heat converting substances 40 (see FIG. 5) for receiving an electric signal from the apparatus. Thus, the electric signal transmitted from the main body of the ink jet recording apparatus is supplied to the electricity/heat converting substances 40.

A support member 300 made of a metallic material to support the wiring board 200 from the rear surface side serves as a bottom plate for the ink jet unit 13. A retaining spring 500 is designed in the M-shaped configuration such that the common liquid chamber 1301 (see FIG. 5) is pressed by the central part of the retaining spring 500 having an M-shaped configuration with a low intensity of pressure and a part of the liquid passages, preferably, the region in the vicinity of the discharge ports 30 is concentrically pressed by fore bent parts 501 of the retaining spring 500 with a certain intensity of line pressure. The heater board 100 and the ceiling plate 1300 are engaged with each other in the clamped state when the foot portions of the retaining spring 500 extend through holes 3121 on the support member 300 and come in engagement with the rear surface side of the support member 300, whereby the heater board 100 and the ceiling plate 1300 are immovably held while coming in pressure contact with each other under the effect of the concentrative biasing force given by the retaining spring 500 via its fore bent portion 501. The support member 300 includes holes 312, 1900 and 200 which are to be engaged with two position determining projections 1012 and position determining/thermal fusion holding projections 1800 and 1801. In addition, the support member 300 includes position determining projections 2500 and 2600 on the rear surface side which are to be engaged with the carriage 16. Further, the support member 300 includes a hole 320 through which an ink supply pipe 2200 (to be described later) extending from the ink tank 14 projects. The wiring board 200 is adhesively secured to the support member 300 using an adhesive or the like.

Figure 7:
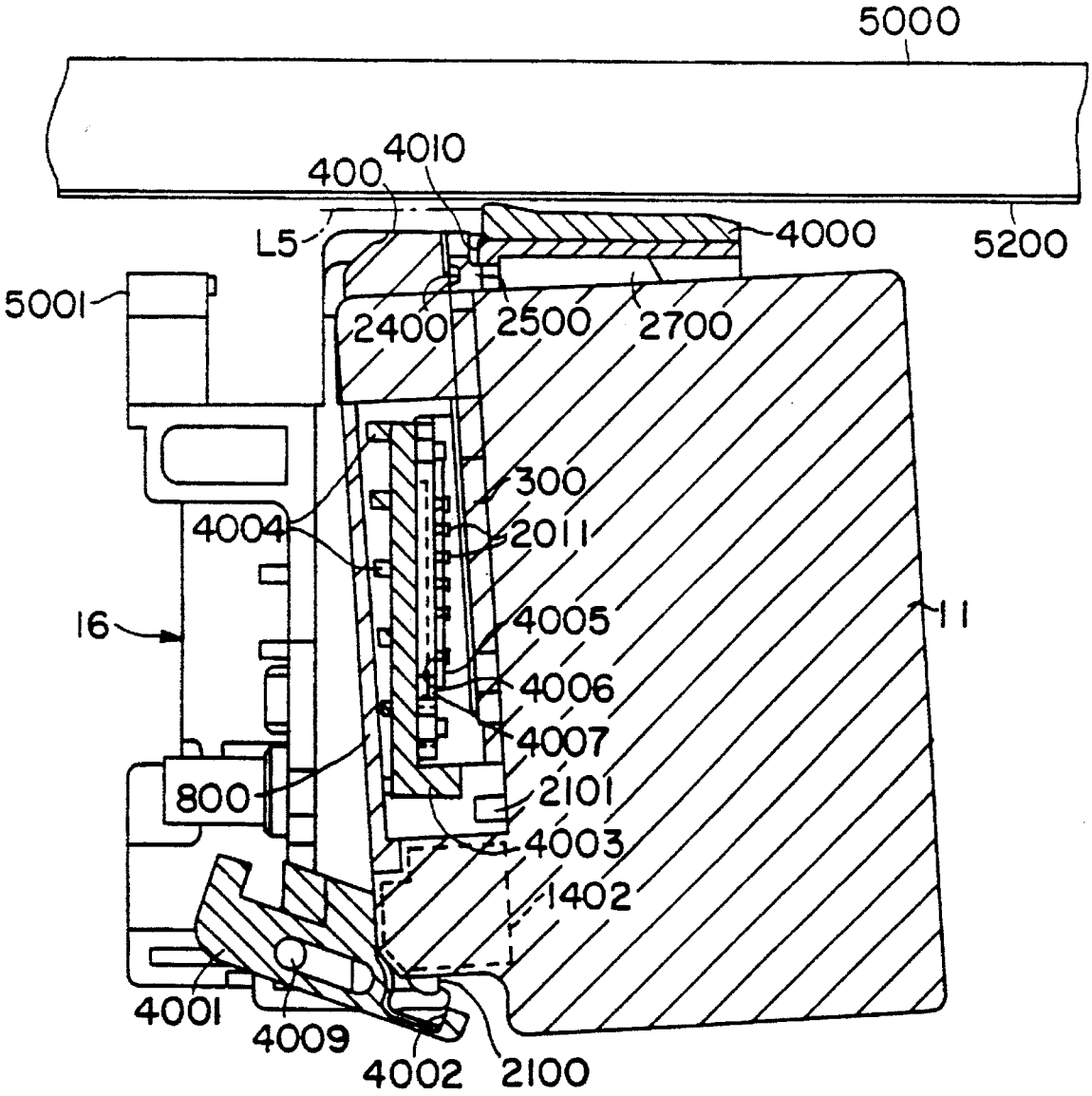
FIG. 7 is a sectional plan view showing the ink cartridge employable with the second embodiment of the ink recorder according to the present invention shown in FIGS. 3 and 4, particularly showing that the ink jet cartridge is mounted on a carriage.

Recesses 2500 on the support member 300 are formed in the vicinity of projections 2500 and 2600 so as to prevent dust, ink or similar foreign materials from reaching the projections 2500 and 2600 in the fore region of the ink jet recording head coincident with parallel grooves 3000 and 3001 formed around the three sides of the support member 300 when the ink cartridge 11 is assembled (as shown in FIG. 3). As shown in FIG. 7, a cover member 800 having parallel grooves 3000 formed thereon serves as an outer wall for the ink cartridge 11, and a hollow space is defined between the cover member 800 and the ink jet tank 14 to receive the ink jet unit 13. In this case, the ink supply member 600 having parallel grooves 3001 formed thereon is prepared in the form of a cantilever which includes an ink conduction pipe 1600 extending subsequent to the ink supply pipe 2200 while the ink supply pipe 2200 is immovably held.

The opening portion of the ink supply member 600 to which the present invention has been applied in the above-described manner is located at the bent part of the ink conduction pipe 1600 extending subsequent to the ink supply pipe 2000. The case in which the opening portion at the bent part highlights the kinds of remarkable effects which may be achieved by using the present invention described in this specification. Referring to FIG. 4, a sealing member is shown in the form of a sealing pin 602 which requires an adhesive as employed for the conventional ink jet recording apparatus. However, a sealing mechanism to be described later may be substituted for the sealing pin 602.

A packing 601 is disposed between the ink tank 14 and the ink supply pipe 2200 to achieve connection and junction therebetween, and a filter 700 is disposed at the end of the ink supply pipe 22 on the ink tank 14 side.

Since the ink supply member 600 is produced by employing a molding process, it can be obtained at an inexpensive cost with high positional accuracy but without any reduction of accuracy during production steps. In addition, the pressure contact state between the ink supply member 600 and the ink receiving port 1500 of the ink conduction pipe 1600 is kept stable on a mass production line because the ink conduction pipe 1600 is constructed in the form of a cantilever. In this embodiment, the complete communication state can reliably be obtained merely by pouring an adhesive employable for a sealing operation from the ink supply member 600 side. Secure attachment of the ink supply member 600 to the support member 300 can simply be achieved by pushing two pins (not shown) on the rear surface side of the ink supply member 600 through the holes 1901 and 1902 on the support member 300 and then thermally fusing them together. The slightly projected region on the rear surface side of the ink supply member 600 where the thermal fusion has been completed is received in a recess (not shown) on the side surface of the ink tank 14 on the ink jet unit 13 mounting side. Thus, the position determining surface of the ink jet unit 13 can be obtained accurately.

Next, a structure of the ink tank 14 will be described below.

The ink tank 14 is composed of a cartridge main body 1000, an ink absorbing body 900 and cover member 1100, and after the ink absorbing body 900 is inserted into the cartridge main body 1000 from the opposite side relative to the ink jet unit 13, the cover member 1100 is sealably secured to the cartridge main body 1000.

The ink absorbing body 900 is intended to hold ink in the impregnated state, and it is accommodated in the ink cartridge main body 1000 by inserting the former into the latter. The impregnated state of the ink absorbing body 900 will be described later in detail. An ink supply port 1200 is intended to supply ink to the ink jet unit 13. In addition, the ink supply port 1200 serves as a supply port which assures that the ink absorbing body 900 is impregnated with ink at a step of assembling the ink jet cartridge 11. The ink tank 14 is formed with an atmosphere communication port 1401 through which the environmental atmosphere is communicated with the interior of the ink tank 14, and a liquid expelling material 1400 is disposed inside of an atmosphere communication port 1401 so as to prevent the ink from leaking from the atmosphere communication port 1401.

In this embodiment, to assure that ink is effectively supplied from the ink absorbing body 900, the air remaining space in the ink tank 14 defined by ribs 2300 on the cartridge main body 1000 and partial ribs 2310 and 2320 on the cover member 1100 continuously extends from the atmosphere communication port 1401 side to reach the corner region farthest away from the ink supply port 1200. To this end, it is important that ink is effectively and uniformly supplied from the ink supply port 1200 side to the ink absorbing body 900. It is very advantageous from the view point of practical use of the ink tank 14 to employ a process of effectively and uniformly supplying ink from the ink supply port 1200 to the ink absorbing body 900. In practice, four ribs 2300 are arranged at the rear part of the cartridge main body 1000 while extending in parallel along the direction of slidable movement of the carriage 16 (see FIG. 8) so as to prevent the ink absorbing body 900 from coming close contact with the rear surface of the cartridge main body 1000. On the other hand, the partial ribs 2310 and 2320 are arranged on the inner surface of the cover member 1100 corresponding the ribs 2300 but they are separated away from each other in contrast with the ribs 2300. Thus, the air remaining space on the partial rib 2310/2320 side is increased much more than that on the rib 2300 side. As is apparent from the drawing, the partial ribs 2310 and 2320 are arranged in the distributed state on the surface having an area smaller than a half of all the area of the cover member 1100. The arrangement of the ribs 2300, 2310 and 2320 in that way assures that the ink held in the region on the ink absorbing body 900 farthest away from the ink supply port can stably and reliably be conducted to the ink supply port 1200 side under the effect of capillary action.

Since the ink accommodating space in the ink tank 14 exhibits a rectangular configuration while its longer sides are located on both the side walls, the aforementioned arrangement of the ribs 2300, 2310 and 2320 is advantageously employable. In case that the longer sides of the ink accommodating space are located while extending in the direction of slidable displacement of the carriage 16 (see FIG. 8) or in case that the ink accommodating space in the ink cartridge 14 exhibits a three-dimensional configuration, it is recommendable that ribs are arranged over the whole surface of the cover member 1100 so as to assure that ink supply from the ink absorbing body 900 can be stabilized. Employment of the rectangular configuration is suitable for the purpose of holding ink in the limited space as much as possible. However, to assure that the ink accommodated in the ink tank 14 is used without waste for a recording operation, it is important that ribs each having the aforementioned function are arranged in the two surface regions in the vicinity of the corners of the ink tank 14. In this embodiment, the ribs on the inner surface of the ink tank 14 are arranged such that they are substantially uniformly distributed in the direction of a thickness of the ink absorbing body 900 having the rectangular configuration. With this construction, although the ink in the ink absorbing body 900 is increasingly consumed, a quantity of ink to be used can substantially be maximized while the atmospheric pressure is kept uniform.

Next, a technical concept on arrangement of the ribs will be described in detail below.

Specifically, it is important that when an arc having a radius coincident with a length of the longer side of the rectangular configuration of the ink tank 14 is described with the location as a center at which the ink supply port 1200 of the ink tank 14 is optically projected on the square upper surface of the rectangular configuration of the ink tank 14, the ribs are arranged on the surface area outside of the foregoing arc so as to allow the atmospheric pressure to be quickly exerted on the ink absorbing body 900 located outside of the arc. In this case, the position of the atmospheric pressure communication port 1401 should not be limited only to the position defined above in this embodiment, provided that it is located at the position where the atmospheric pressure can be introduced into the region where the ribs are arranged.

Additionally, in this embodiment, the space required when the ink jet cartridge 11 is incorporated in the ink jet recording apparatus can be minimized by flattening the rear surface of the ink jet cartridge 11 relative to the ink jet recording head 12, resulting in a quantity of ink to be accommodated being maximized. Thus, the ink jet recording apparatus can be designed and constructed with smaller dimensions, and moreover, the frequency with which used cartridges must be exchanged with new ones can be reduced. A projected part of the atmosphere communication port 1401 is formed by utilizing the rear part of the space required for constructing the ink jet unit 13 in the integral structure while the interior of the project part is kept empty, and an atmospheric pressure supply space 1402 is formed at the empty projected part over the whole thickness of the ink absorbing body 900. With such construction, an ink jet cartridge unattainable by practice of the prior art can be provided. The atmospheric pressure supply space 1401 is dimensioned to have a three-dimensional space much larger than that of the conventional ink jet cartridge. Since the atmosphere communication port 1401 is located above the atmospheric pressure supply space 1402, the atmospheric pressure supply space 1402 can temporarily hold ink and allow it to be reliably recovered in the ink absorbing body 900 even when the ink is expelled away from the ink absorbing body 900 due to certain abnormalities. Consequently, an ink jet cartridge having an excellent property enabling ink consumption without waste can be provided.

Figure 6:
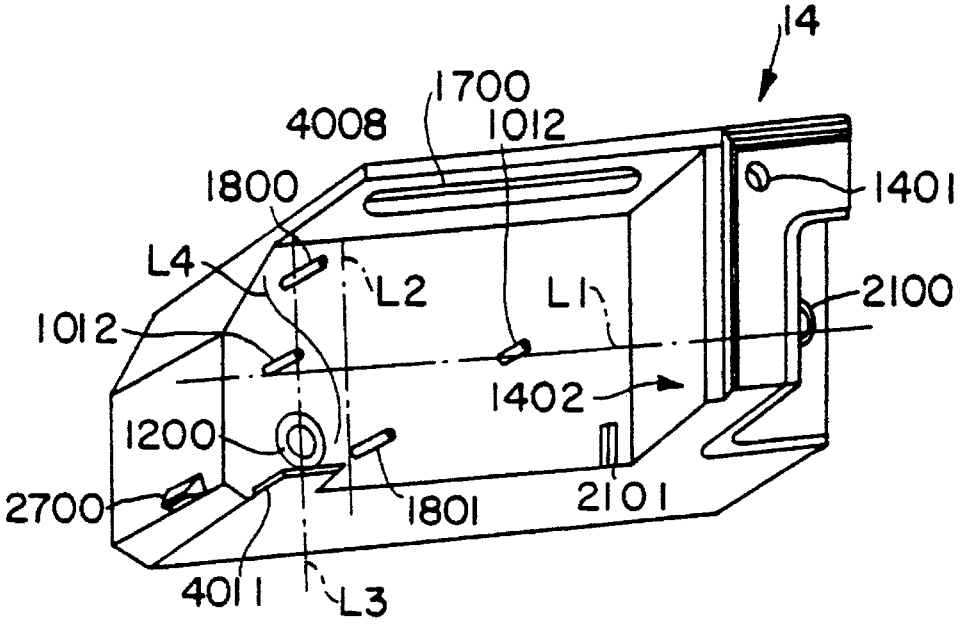
FIG. 6 is a perspective view showing an ink tank employable with the ink cartridge shown in FIGS. 3 and 4 as seen from one side.

The structure of a mounting surface for mounting the ink jet unit 13 on the ink tank 14 is as illustrated in FIG. 5. Here, it is assumed that a straight line extending in parallel with the bottom surface of the ink tank 14 or a reference surface for mounting the carriage 16 through the substantially central part of the discharge ports on the orifice plate 400 is designated by $L_1$. Two position determining projections 1012 adapted to be engaged with holes 312 on the support member 300 are located on the straight line $L_1$. The height of the projections 1012 is dimensioned to be slightly different from the thickness of the support member 300, and the projections 1012 serve to determine the position to be assumed by the support member 300. As shown in FIG. 7, a pawl 2100 to be engaged with an engagement surface 4002 extending at a right angle relative to a position determining hook 4001 for the carriage 16 is located on an extension line extending from the straight line $L_1$. A position determining force to be exerted on the carriage 16 functions in the surface region in parallel with the reference surface including the straight line $L_1$. As will be described later, the aforementioned structural relationship is effectively acceptable because the position determining accuracy only for the ink tank 14 is equal to the position determining accuracy for the ejection ports on the ink jet head 12. The projections 1800 and 1801 on the ink tank 14 corresponding to fixing holes 1900 and 2000 on the support member 300 facing the side wall of the ink tank 14 are dimensioned to have a length longer than that of the projection 1012, and the projections 1800 and 1801 serve to firmly hold a part thereof projected through the support member 300 on the side surface of the support member 300 by thermal fusion. Additionally, it is assumed that a straight line extending past the projection 1800 at a right angle relative to the straight line $L_1$ is designated by $L_3$ and a straight line extending through the projection 1800 in the same way is designated by $L_2$. Since the substantially central part of the ink supply port 1200 is located on the straight line $L_3$, the junction state between the ink supply port 1200 and the ink supply pipe 2200 is kept stable, resulting in a magnitude of load to be exerted on the junction state therebetween due to ink drop or collision of ink droplets being reduced. As is apparent from FIG. 6, the straight line $L_2$ and the straight line $L_3$ are not positionally coincident with each other, and both the projections 1800 and 1801 are located in the vicinity of the projection 1021 on the ejection port side of the ink jet head 12. Thus, there appears a reinforcement effect for determining the position to be assumed by the ink jet head 12 relative to the ink tank 14. Referring to FIG. 6, a curved line $L_4$ represents the position to be assumed by the outer wall of the ink supply member 600 when the latter is mounted on the ink jet recording head 12. Since both the projections 1800 and 1801 are located on the curved line $L_4$, a sufficiently high strength and an excellent positional accuracy are given to both the projections 1800 and 1801 regardless of the weight of the ink supply member 600 exerted on the fore end part of the ink jet head 12. A foremost end flange 2700 of the ink tank 14 is inserted through a slit on a front plate 4000 (see FIG. 7) so as to prevent the position assumed by the ink tank 14 from being extremely adversely dislocated. A disconnection preventive member 2101 for preventing the ink cartridge 11 from being unexpectedly disconnected from the carriage 16 is disposed on a bar (not shown) for the carriage 16. As will be described later, the disconnection preventive member 2101 serves as a protective member for maintaining the mounted state even when the ink jet cartridge 11 is displaced below the foregoing bar while it is located at the position where it is mounted on the carriage 16 in the turned state and a certain force effective for disconnecting the ink jet cartridge 11 from the aforementioned position in the upward direction is exerted on the ink jet cartridge 11.

While the ink tank 14 is closed with the cover member 800 after the ink jet unit 13 is mounted on the ink tank 14, the ink jet unit 13 is surrounded by the ink tank 14 with the exception of its lower opening portion. However, since the lower opening portion of the ink jet unit 13 is located near to the carriage 16, the ink jet cartridge 11 defines a substantially rectangular hollow space. As heat is generated from the ink jet recording head 12 located within the thus defined hollow space, the temperature in the hollow space is increasably maintained with a slight elevation during practical use of the ink jet recording apparatus for a long time. In this embodiment, to assist natural heat radiation from the support member 300, a slit 1700 having a width smaller than that of the hollow space is formed on the upper surface of the ink jet cartridge 11, whereby uniform temperature distribution over the whole ink jet unit 13 is not adversely affected by the environmental atmosphere while preventing undesirable elevation of the temperature of the ink jet unit 13.

When the ink jet cartridge 11 is assembled as illustrated in the drawings, ink in the ink jet cartridge 11 is supplied into the ink supply member 600 from the interior of the ink cartridge main body 1000 via the ink supply port 1200, a hole 320 formed on the support member 300 and an introduction port formed on the rear surface side of the ink supply member 600. After it passes through the interior of the ink supply member 600, it flows in the common liquid chamber 1301 from a discharge port of the ink supply member 600 via supply pipe (not shown) and the ink receiving port 1500 on the ceiling plate 1300. A packing such as the packing 601 molded of, e.g., a silicon rubber, a butyl rubber or the line is sealably disposed at each junction portion usable for ink communication so as to provide an ink supply passage.

As described above, since each of the ink supply member 600, the ceiling plate 1300, the orifice plate 400 and the cartridge main body 1000 is prepared as an integrally molded component, an assembling operation can be performed with high accuracy, and moreover, they can be produced on a mass production line with a highly improved quality. In addition, since the number of components is reduced compared with the conventional ink jet recording apparatus, desired excellent properties can be reliably achieved.

In this embodiment, as shown in FIG. 3, a gap 1701 appears between the upper surface 603 of the ink supply member 600 and the end part 4008 of the ceiling plate for the ink tank 14 having an elongated opening portion 1700 formed thereon after the ink jet cartridge 11 is assembled as illustrated in the drawings. Similarly, a gap (not shown) is formed between the lower surface 604 of the ink supply member 600 and the end part 4011 on the head side of a thin plate member having the cover member 1100 adhesively attached thereto at the lower end of the ink tank 14. Each of the aforementioned gaps increasingly promotes a function of heat radiation through the opening portion 1700 and prevents any unnecessary force exerted on the ink tank 14 from being transmitted directly not only to the ink supply member 600 but also to the ink jet unit 13.

At any rate, each of the aforementioned structures in accordance with the embodiment of the present invention has not been realized with a conventional recording apparatus. Each of the structures can individually exhibit an advantageous effect, and moreover, they can exhibit a particularly advantageous effect in the combined state.

Figure 8:
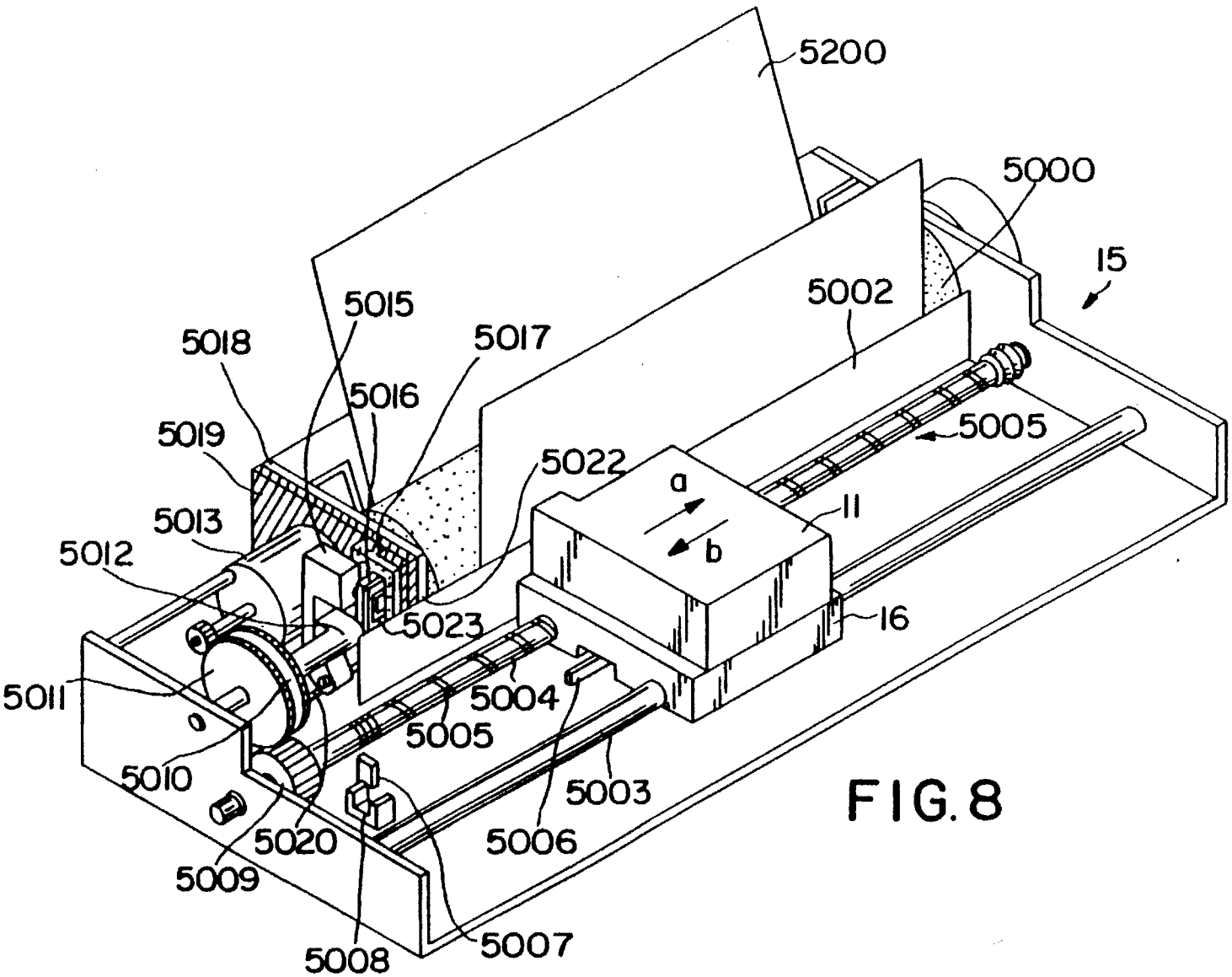
FIG. 8 is a perspective view showing an ink recorder in the form of an ink jet recording apparatus to which the present invention is applied.

Next, a manner of mounting the ink jet cartridge 11 on the carriage 16 will be described below with reference to FIG. 7 and FIG. 8. As shown in FIG. 8, a platen roller 5000 guides the movement of a recording medium 5200 (e.g., a recording paper) from the region behind the platen roller 5000 toward the region in front of the same as seen in the drawing. The carriage 16 is adapted to move in the longitudinal direction of the platen roller 5000, and the ink jet recording apparatus 15 includes a front plate 4000 (having a thickness of 2 mm) located in front of the carriage 16, i.e., not only on the platen roller 5000 side but also on the front surface side of the ink jet cartridge 11, a support plate 4002 for an electric connector to be described later and a hook 4001 for determining the position for the purpose of immovably holding the ink jet cartridge 11 at a predetermined recording position. The front plate 4000 includes two position determining projected surfaces 4010 corresponding to projections 2500 and 2600 on the support member 300 for the ink jet cartridge 11. After the ink jet cartridge 11 is mounted on the carriage 16, a vertical force oriented toward the projected surfaces 4010 is exerted on the front plate 4000. For this reason, a plurality of reinforcement ribs (not shown) extending in the direction of the vertical force are formed on the front plate 4000 on the platen roller 5000 side. Each of the reinforcement ribs serves as a head protecting projection which is projected slightly toward the platen roller 5000 side (about 0.1 mm) from a position $L_5$ assumed by the front surface of the front plate 4000 when the ink jet cartridge 11 is mounted on the carriage 16. The support plate 4003 includes a plurality of reinforcement ribs each extending in the vertical direction as seen in the drawing, and a rate of projection of each reinforcement rib 4004 in the sideward direction is reduced from the platen roller 5000 side toward the hook 4001 side, whereby the ink cartridge 11 is mounted on the carriage 16 in the inclined state. In addition, the support plate 4003 includes a flexible plate 4005 having a plurality of pads 2011 formed thereon corresponding to the pads 201 on the wiring board 200 for the ink jet cartridge 11 and a rubber sheet 4007 having a plurality of projections formed thereon for generating an elastic force effective for pressing the pads 2011 from the rear surface side. To stabilize the electric contact state between the pads 201 and the pads 2011, the support plate 4003 includes a position determining surface 4006 on the hook 4001 side corresponding to the projection surface 4010 so as to allow a functional force to be exerted on the ink jet cartridge 11 in the reverse direction relative to the direction of functioning on the projected surface 4010. Thus, the pad contact region is formed between the pads 201 and the pads 2011, and a quantity of deformation of the projections on the rubber pad sheet 4007 corresponding to the pads 2011 is restrictively determined. When the ink jet cartridge 11 is firmly mounted on the carriage 16 at the position where a recording operation can be performed, the position determining surface 4006 is held in such a state that it comes in contact with the surface of the wiring board 200. Since the pads 201 are distributively arranged in the symmetrical relationship relative to the straight line $L_1$, a quantity of deformation of the projections on the rubber pad sheet 4007 can be uniformalized, and the contact pressure between the pads 2011 and the pads 201 can increasingly be stabilized. In this embodiment, the pads 201 are distributed such that two rows of pads are arranged in the transverse direction not only in an upper half of the wiring board 200 but also in a lower half of the same, while two rows of pads are arranged in the vertical direction on the wiring board 200.

The hook 4001 includes an elongated hole adapted to be engaged with a fixing shaft 4009, and the position of the ink jet cartridge 11 relative to the carriage 16 is determined by displacing the hook 4001 in the longitudinal direction of the platen roller 5000, especially, in the leftward direction after it turns in the anticlockwise direction from the position shown while utilizing the displacement space of the elongated hole. Although the hook 4001 may be displaced by employing any means, it is preferable that it is displaced by actuating a lever or the like. At any rate, while the hook 4001 turns in that way, the ink jet cartridge 11 is displaced toward the platen roller 5000 side, whereby the position determining projections 2500 and 2600 are displaced to reach the position where they come in contact with the projecting surface 4010 on the front plate 4000. As the hook 4001 is displaced in the leftward direction, the ninety degree hook surface 4002 comes in close contact with the ninety degree surface of the pawl 2100 on the ink jet cartridge 11, whereby the ink jet cartridge 11 turns in the horizontal plane about the region where the projection 2050 contacts the projecting surface 4010 until the pads 201 and the pads 2011 come in contact with each other. When the hook 4001 is held at a predetermined position, i.e., at the stationary position, the complete contact state between the pads 201 and the pads 2011, the complete surface contact state between the projections 2500 and 2600 and the projected surface 4010, the surface contact state between the ninety degree surface 4002 of the hook 4001 and the ninety degree surface of the pawl 2100 and the surface contact state between the wiring board 200 and the position determining surface 4006 are simultaneously established, resulting in firm holding of the ink jet cartridge 11 relative to the carriage 16 being accomplished.

Next, an outline of the ink recorder in the form of an ink jet recording apparatus will be described below with reference to FIG. 8.

FIG. 8 is a perspective view of an ink recording apparatus 15 to which the present invention is applied. A lead screw 5005 having a spiral groove 5004 formed across the full length thereof is operatively connected to a driving motor 5013 via driving power transmission gears 5011 and 5009 so that it is rotated in the normal direction or in the reverse direction. The carriage 16 is operatively engaged with the spiral groove 5004 via a pin (not shown) attached to a securing portion 5001 (see FIG. 7), and moreover, slidable movement of the carriage 16 is properly guided by a guide rail 5003 so that the carriage 16 is reciprocably displaced not only in the a arrow-marked direction as seen in the drawing. A paper retaining plate 5002 is arranged across the full length of the platen roller 5000 in the direction of displacement of the carriage 16 so as to allow the recording medium 5200 to be pressed against the platen roller 5000. Photocouplers 5007 and 5008 constitute home position detecting means for optically confirming the presence of a lever 5006 on the carriage 16 in their working region and then reversing the direction of rotation of the driving motor 5013. A cap member 5022 adapted to cap the front surface of the ink jet recording head 12 is supported by a support member 5016 and includes sucking means 5015 so as to allow the ink jet recording head 12 to be attracted to and retracted away from the cap member 5022 with the aid of a cap-in opening portion 5023. A support plate 5019 is secured to a main body support plate 5018, and a cleaning blade 5017 slidably supported by the support plate 5019 is displaced in the forward/rearward direction by activating a driving means (not shown). The shape of the cleaning blade 5017 should not be limited only that shown one but any one of hitherto known cleaning blades of course may be employed for practicing the embodiment of the present invention. A lever 5012 is arranged to start an advancing/retracting operation for the cleaning blade 5017. Specifically, the lever 5012 is displaced as a cam 5020 coming in slidable contact with the carriage 16 is displaced, and displacement of the lever 5012 is controlled by hitherto known power transmitting means such as a gear 5010, a clutch or the like for transmitting driving power generated by the driving motor 13.

Respective treatments comprising capping, cleaning and advancing/retracting are achieved at the corresponding position by the function of the lead screw 5005 when the carriage 16 reaches the operative region on the home position side. Provided that required operations can be performed in the known timing relationship, any structure may be employed for practicing the embodiment of the present invention. Since each of the aforementioned structures is advantageously acceptable not only on the individual basis but also in the combined state, it exhibits a preferable example for carrying out the present invention.

Figure 9:
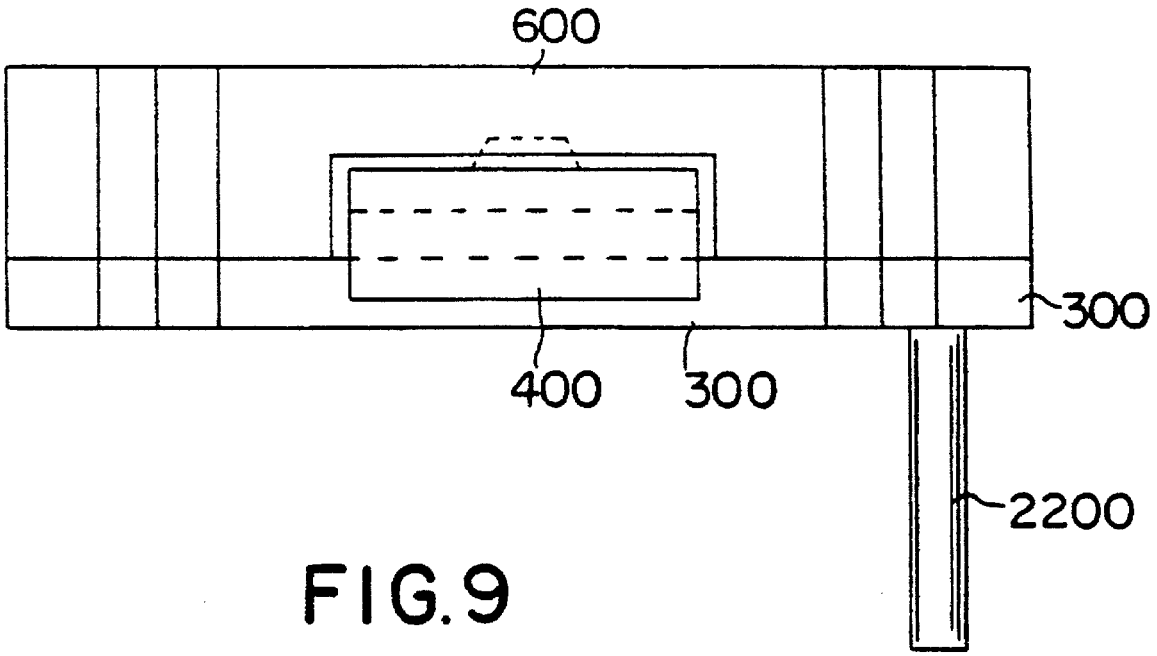
FIG. 9 is a front view showing an ink jet unit for the ink recorder shown in FIG. 8 as seen in the Z arrow-marked direction in FIG. 1, particularly illustrating by way of an example an ink jet recording head.

FIG. 9 is a front view which shows by way of an example an ink jet recording head employable for the ink jet unit shown in FIG. 1 as seen the Z arrow-marked direction. In FIG. 9, reference numeral 300 designates a support member made of a metallic material, reference numeral 400 designates an orifice plate having a plurality of ink ejection ports arranged thereon and reference numeral 600 designates an ink supply member molded of a synthetic resin and including a bent part.

With such construction, it is important for the ink jet recording head that a ceiling plate of the ink supply member 600 comes in close contact with a base plate on the support member 300 including a plurality of discharge energy generating elements in order to reliably prevent ink from leaking from the ink jet recording head. The retaining spring 500 shown in FIG. 4 can be noted as means for reliably maintaining the close contact state between both the plates.

Next, means for reliably maintaining the close contact state between both the plates without employment of the retaining spring as mentioned above will be described below with reference to FIG. 10 to FIG. 15.

Figure 10:
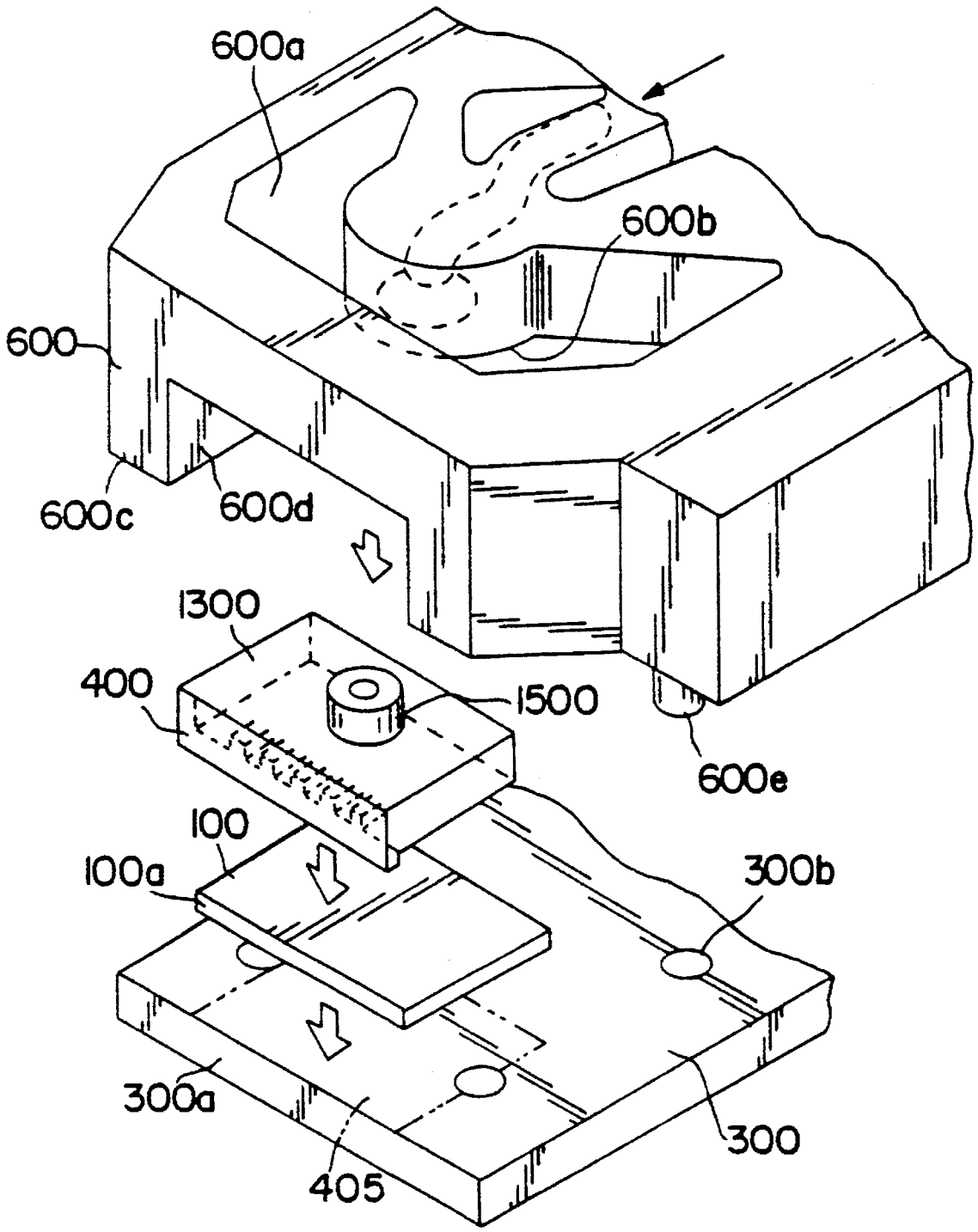
FIG. 10 is an exploded view showing the ink jet recording head in accordance with a modified embodiment of the present invention, particularly showing essential components constituting the ink jet recording head.
Figure 11:
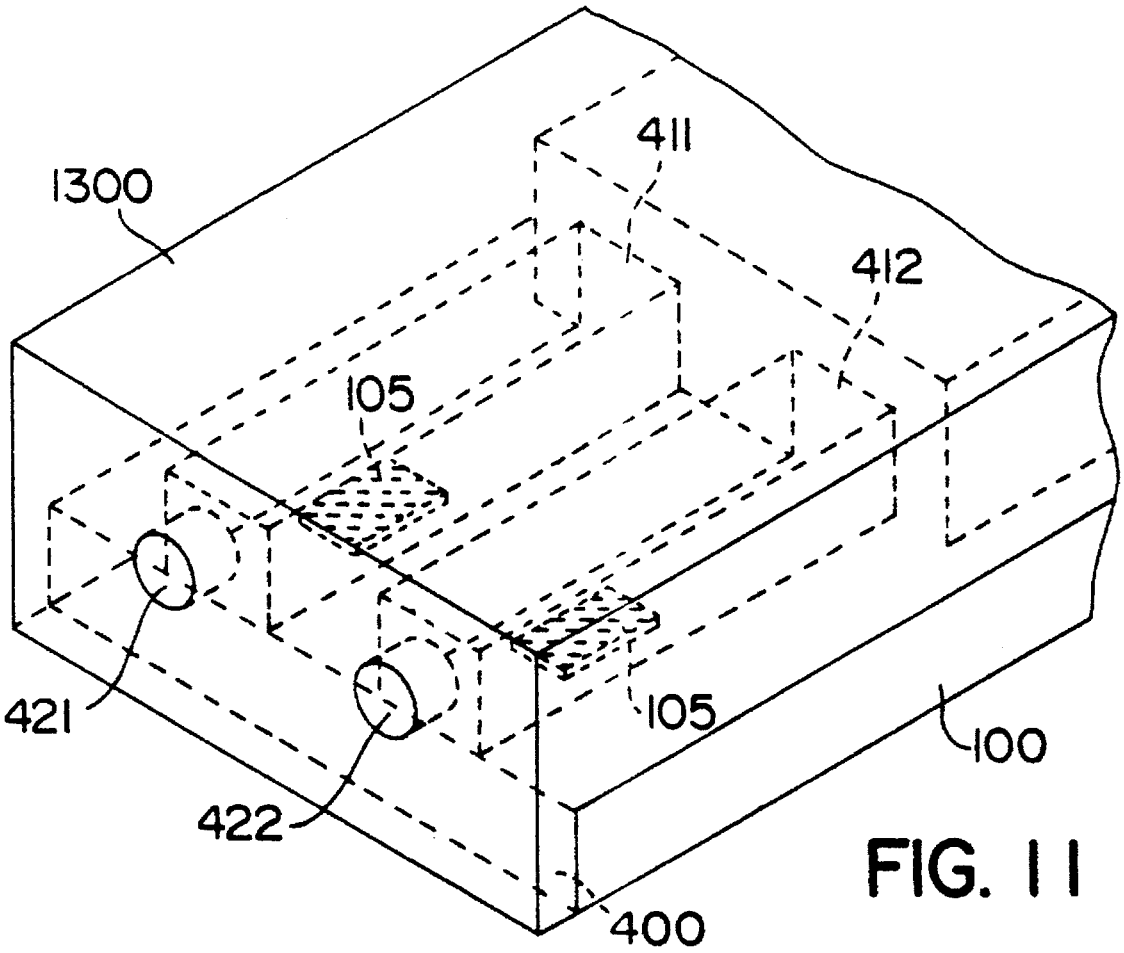
FIG. 11 is an enlarged fragmentary perspective view showing the ink jet recording head shown in FIG. 10, particularly showing an essential part of the same.

FIG. 10 is a perspective view of an ink jet recording head in accordance with a modified embodiment of the present invention as shown in FIG. 9, particularly illustrating essential components constituting the ink jet recording head in the disassembled state, and FIG. 11 is a perspective view of the ink jet recording head shown in FIG. 10, schematically illustrating an essential part of the ink jet recording head.

The same structural elements constituting the ink jet recording head shown in FIG. 10 and FIG. 11 as those shown in FIG. 4 are designated by same reference numerals. Thus, for the purpose of simplification, repeated description of them will not be required.

Referring to FIG. 10, a predetermined region 405 in the vicinity of a fore end surface 300*a* on the surface of a support member 300 is coated with an adhesive having a predetermined thickness, and a heater board 100 is fixedly mounted on the coated surface with the aid of the adhesive such that the fore end surface 100*a* of the heater board 100 is flush with the fore end surface 300*a* of the support member 300. As shown in FIG. 11, a ceiling plate 1300 is placed on the heater board 100. Specifically, the ceiling plate 1300 includes an orifice plate 400 which is arranged in the temporarily connected state such that it is located ahead of the fore end surface 100*a* of the heater board 100 and the fore end surface 300*a* of the support member 300. In FIG. 11, reference numeral 105 designates a discharge heater which is disposed at a predetermined position on the heater board 100 to serve as an electricity/heat converting substance. Reference numerals 411 and 412 designate ink flow passages each of which is formed in the ceiling plate 1300 in the form of a closed groove, and reference numerals 421 and 422 designate discharge ports which are formed through the orifice plate 400 of the ceiling plate 1300.

As shown in FIG. 10, an ink supply member 600 is placed on the ceiling plate 1300 and the support member 300 both of which are temporarily connected to the heater board 100. It is necessary that a material having rigidity enough to suppress warpage of the ceiling plate 1300 is employed as a material for the ink supply member 600. In addition, it is necessary that a molding material adapted to be elastically deformed such that a part thereof to be connected to the ceiling plate 1300 can come in close contact therewith is selected as a material for the ink supply member 600.

As is apparent from FIG. 10, the ink supply member 600 is molded to be comparatively thick, and a substantially V-shaped opening portion 600*a* is formed through the central part of the ink supply member 600. In addition, a cantilevered ink flow passage portion 600*b* serving as pressing means extends forward from the rear end of the opening portion 600*a*. As seen in FIG. 10, the cantilevered ink flow passage portion 600*b* has a distal portion with an ink supply port, a base portion connected to the rear end of the opening portion 600*a*, and a connecting neck portion (connecting the distal portion and base portion) tapering outwardly from the distal portion to the base portion. A part of the bottom of the ink supply member 600 is recessed in the rectangular configuration while extending from the front surface 600*c* of the ink supply member 600 so as to form a recess 600*d* in which the heater board 100 and the ceiling plate 1300 are received. A pair of cylindrical foot portions 600*e* (only one of them shown in the drawing) adapted to be inserted into a pair of holes 300*b* (only one of them shown in the drawing) formed through the support member 300 to serve as reinforcing/fixing means are integrated with the ink supply member 600 on the opposite side relative to the opening portion 600*a* at the bottom of the same.

A length of each of the foot portions 600*e* is properly determined based on the depth of each hole 300*b* formed through the support member 300, i.e., a thickness of the support member 300 such that a part of each foot portion 600*e* is projected outside of the bottom surface of the support member 300.

Next, an example of a process of assembling the ink jet recording head as constructed in the above-mentioned manner will be described below.

First, the heater board 100 is adhesively placed on the support member 300 with the aid of an adhesive. After the position of the ceiling plate 1300 is correctly aligned with the heater board 100, the ceiling board 1300 is temporarily connected to the heater board 100 using an ultraviolet ray hardening type adhesive.

Subsequently, the ink supply member 600 is placed on the ceiling plate 1300 and the support member 300, and at the same time, the foot portions 600*e* are inserted through the holes 300*b* such that they are projected slightly away from the bottom surface of the support member 300. After the support member 300 is temporarily fixedly held by actuating a jig (not shown), a cylindrical ink receiving port 1500 on the ceiling plate 1300 is pressed toward the support member 300 side by the ink supply member 600, and the foot portions 600*e* of the ink supply member 600 inserted through the holes 300*b* are projected away from the bottom surface of the support member 300. While the foregoing state is maintained, the ink supply member 600 is slightly warped with the ink supply port of the ink flow passage portion 600*b* engaged with the upper surface of the ink receiving port 1500 as a fulcrum. Then, the ink supply member 600 can be fixed to the support member 300 by securing the lowermost ends of the foot portions 600*e* of the ink supply member 600 to the rear surface of the support member by thermal fusion. Once the ink supply member 600 has been fixedly secured in that way, the ceiling plate 1300 can be connected to the heater board 100 while coming in close contact with the same.

Figure 12:
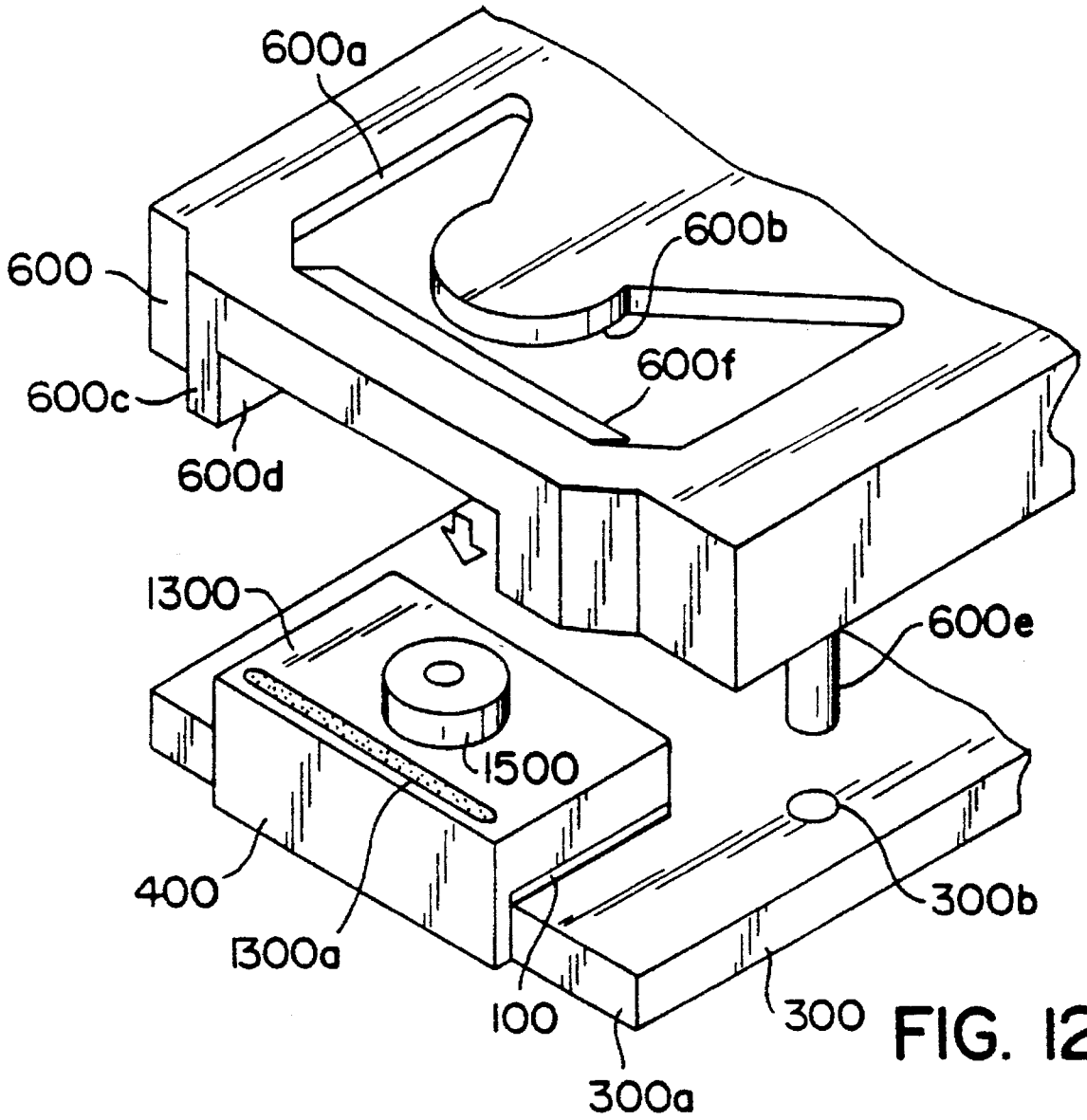
FIG. 12 is an exploded view showing an ink jet recording head employable with another modified embodiment of the ink jet unit shown in FIG. 1 according to the present invention, particularly showing essential components constituting the ink jet unit.

FIG. 12 is a perspective view of an ink jet recording head in accordance with another modified embodiment of the present invention, particularly illustrating essential components constituting the ink jet recording head in the disassembled state.

Referring to FIG. 12, a flap-shaped tongue 600*f* fixedly held in the cantilever-shaped state while extending in the rearward/downward direction to serve as pressing means is arranged inside of the fore end of an opening portion 600*a* of an ink supply member 600. In this embodiment, the tongue 600*f* is internally molded with the ink supply member 600.

Next, an example of a process of assembling the ink jet recording head in accordance with the modified embodiment of the present invention will be described below. First, the ink supply member 600 including the tongue 600*f* is placed on a support member 300 having a ceiling plate 1300 and a heater board 100 adhesively fixed thereto, and subsequently, a pair of foot portions 600*e* each serving as reinforcing/fixing means are inserted through a pair of holes 300*b* on the support member 300. At this time, an ink supply port in the distal end of the cantilevered ink flow passage portion 600*b* of the ink supply member 600 is engaged with an ink receiving port 1500 of a ceiling plate 1300, while the tongue 600*f* comes in contact with an upper surface 1300*a* of an orifice plate. While the foremost ends of the foot portions 600*e* are projected away from the bottom surface of the support member 300, the former can be fixed to the latter by thermal fusion. As long as the foregoing fixed state is maintained, the ink receiving port 1500 and the upper surface 1300*a* of the orifice plate 1300 can sealably be pressed by the ink flow passage portion 600*b* and the tongue 600*f*.

Figure 13A:
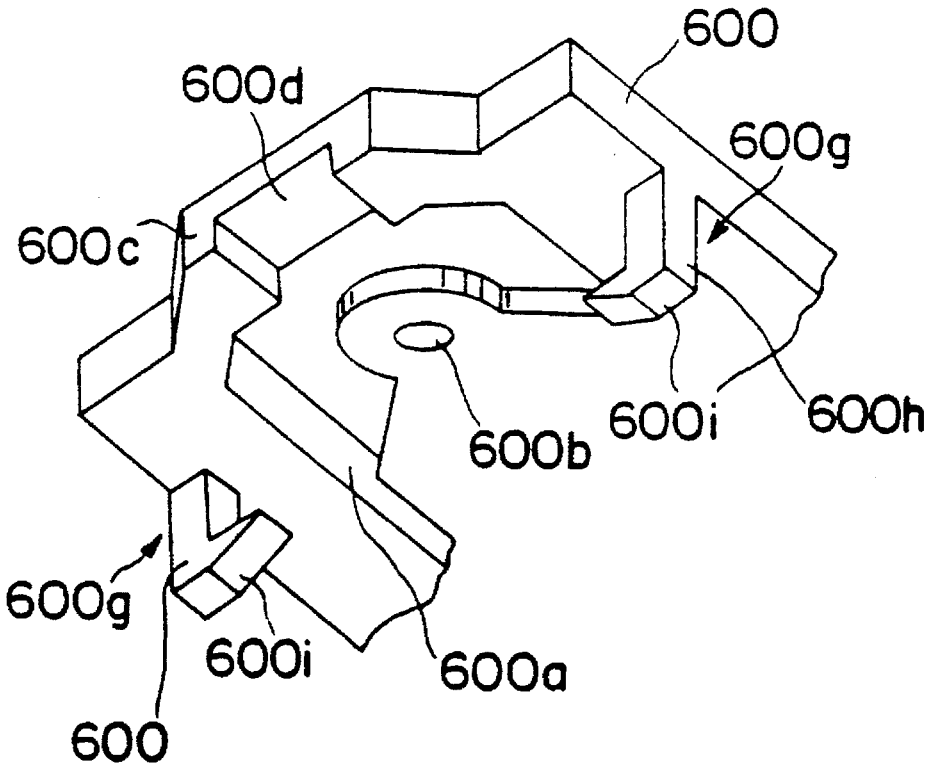
FIG. 13A is a fragmentary perspective view showing an ink jet recording head employable with another modified embodiment of the ink jet unit shown in FIG. 1 according to the present invention, particularly showing an ink supply member for the ink jet recording head.
Figure 13B:
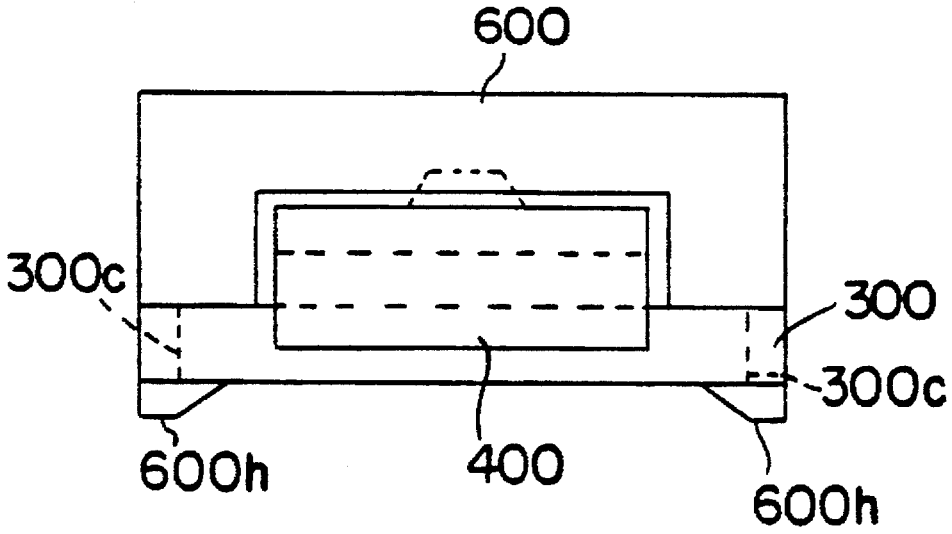
FIG. 13B is a front view showing the ink jet head having the ink supply member shown in FIG. 13A incorporated therein.

FIG. 13A is a fragmentary perspective view of an ink supply member for an ink jet recording head in accordance with another modified embodiment of the present invention, and FIG. 13B is a front view of the ink supply member shown in FIG. 13A, particularly illustrating that it is secured to the support member.

A structure of the ink supply member 600 is substantially coincident with that of the ink supply member 600 as shown in FIGS. 10 and 12. A different point of the former from the latter consists in that a pair of foot portions 600*g* are substituted for the foot portions 600*e* on the bottom of the ink supply member 600 shown in FIGS. 10 and 12. Each of the foot portions 600*g* are prepared in the form of a substantially L-shaped member and comprises a main body 600*h* extending downward from the bottom of the ink supply member 600 on the outer side of an opening portion 600*a* and an engagement portion 600*i* bent from the lower end of the main body 600*h* toward the opening portion 600*a* side while exhibiting a wedge-shaped sectional shape. In this embodiment, each of a pair of notches 300*c* formed through the support member 300 is cut out to reach the side wall of the support member 300. Thus, each notch 300*c* has a substantially rectangular shape.

Next, an example of a process of assembling the ink jet recording head in accordance with the modified embodiment of the present invention will be described below. First, the ink supply member 600 including the foot portions 600*g* is placed on the support member 300 having a ceiling plate 1300 and a heater board 100 adhesively fixed thereto, and subsequently, the engagement portions 600*i* of the foot portions 600*g*, are correctly aligned with a pair of notches 300*c* formed through the support member 300. After the support member 300 is temporarily firmly held by actuating a certain jig (not shown), the ink support member 600 is pressed toward the support member 300, causing the engagement portions 600*i* of the foot portions 600*g* to be turnably displaced below the bottom of the support member 300 while the foot portions 600*g* themselves are deformed in the outward direction. Thus, since an ink receiving port 1500 of the ceiling plate 1300 is pressed toward the support member 300 side by an ink flow passage 600*b* of the ink supply member 600, close contact state between the ceiling plate 1300 and the heater board 100 can reliably be established.

The ink jet recording head in accordance with the modified embodiment of the present invention has an advantage that a caulking step can be eliminated from a series of steps of assembling the ink jet recording head as shown in FIGS. 10 to 12. In addition, since there is a possibility that a unit employable for practicing the caulking step can be saved, the ink jet recording head can be produced at a reduced cost.

Figure 14:
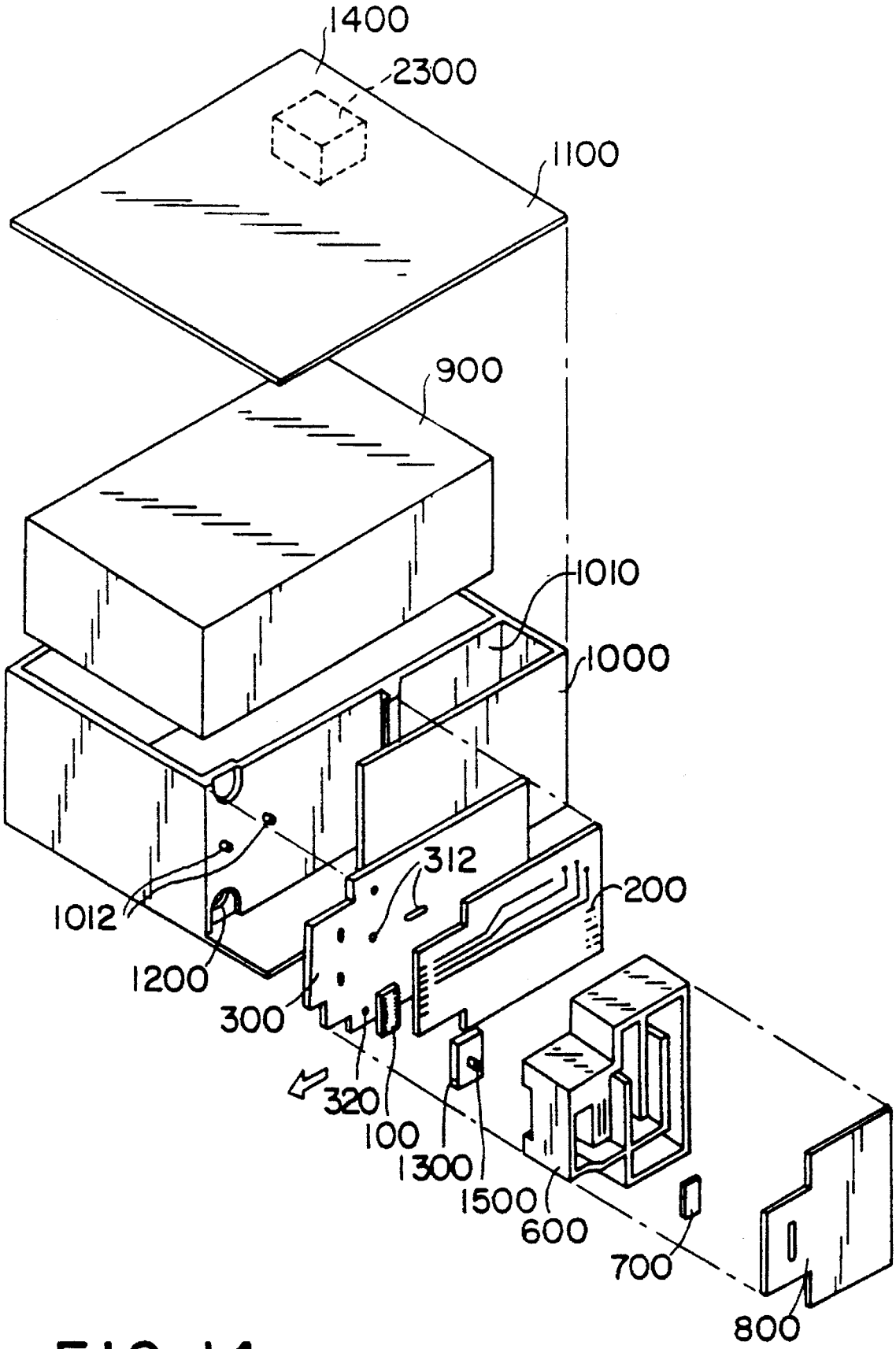
FIG. 14 is a perspective view showing an ink jet cartridge including the ink supply member shown in FIG. 1, particularly showing by way of an example the structure of the ink jet cartridge.
Figure 15:
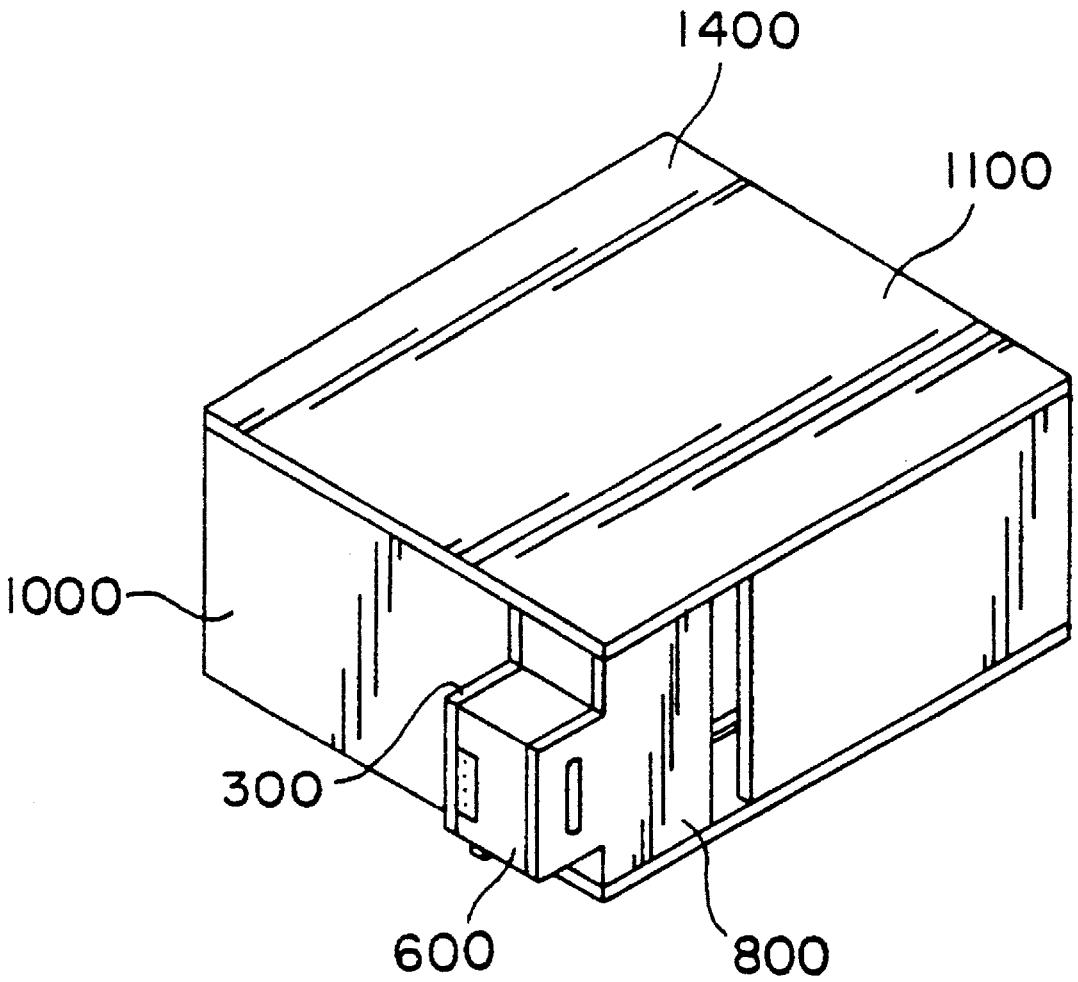
FIG. 15 is a schematic perspective view showing the ink jet cartridge shown in FIG. 14.

FIGS. 14 and 15 show by way of an example an ink jet unit having the ink jet recording unit as mentioned above incorporated therein. FIG. 15 is a perspective view of the ink jet unit shown in FIG. 14 after completion of an assembling operation.

Referring to FIG. 12 or FIGS. 13A and 13B, position determining holes 312 adapted to be engaged with two position determining projections 1012 on the ink tank are formed through the support member 300. In addition, a hole 320 through which an ink supply pipe can pass for the purpose of supplying ink from the ink tank is formed through the support member 300. Firm securing of the wiring board 200 to the support member 300 is achieved by using an adhesive or a similar material. In FIG. 14, reference numeral 700 designates a filter which is disposed at one end of the ink supply pipe on the ink tank side. As is apparent from FIG. 12 or FIGS. 13A and 13B, a cover member 800 forms an outer wall for an ink jet cartridge, and moreover, defines a hollow space for accommodating an ink jet unit in cooperation with the ink tank. The ink tank is constructed of a cartridge main body 1000, an ink absorbing body 900 and a cover member 1100 for sealably closing the ink absorbing body 900 therewith after the latter is inserted into the cartridge main body 1000 from the side wall on the opposite side relative to the mounting surface of the cartridge main body 1000 for mounting the ink unit.

Reference numeral 900 designates a group of ink absorbing bodies in which ink is impregnated. The ink absorbing bodies 900 are arranged in the cartridge main body 1000. Reference numeral 1010 designates an atmospheric pressure supplying space which is dimensioned to have a thickness equal to the full thickness of the ink absorbing bodies 900. When ink is expelled from the ink absorbing bodies 900 due to some abnormality, the atmospheric pressure supplying space 1010 serves to temporarily hold the ink therein so that the ink can reliably be recovered in the ink absorbing bodies 900. For this reason, the atmospheric pressure supplying space 1010 has an effect of preventing ink from being uselessly consumed. Reference numeral 1200 designates an ink supply port through which ink is supplied to the ink jet unit. Reference numeral 1400 designates an atmosphere communication port on a cover member 1100 through which the interior of the cartridge main body 1000 is communicated with an environmental atmosphere. Reference numeral 2300 designates a rib which is formed on the bottom surface of the cover member 1100.

With the ink jet unit as constructed in the above-described manner, the ink jet recording head incorporated in the ink jet unit assures that ink can be injected through a plurality of discharge ports arranged on an orifice plate 400 because it provides excellent close contact between a ceiling plate 1300 and a heater board 100, and moreover, reliably prevents malfunctions such as ink leakage or the like.

As described above, the ink jet unit is constructed such that the ink tank is equipped with reinforcing/fixing means and at least a part of the ink tank is made of a deformable material so as to press a ceiling plate and a base plate connected to each other by deformation of the ink tank at the time when the ink tank is fixedly secured to the ceiling plate and the base plate. Thus, the sealable close contact state between the ceiling plate and the base plate already connected to each other can be improved substantially.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds the nucleate boiling point so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressures waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks of different color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value such that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet cartridge comprising:

a ceiling plate having an ink receiving port and a plurality of grooves as an ink passage, said grooves being communicated with said ink receiving port;

a base plate having a plurality of discharge energy generating elements for generating sufficient discharge energy to discharge ink;

an ink supply member having a cantilevered ink supply portion with an ink supply port connected with said ink receiving port for supplying ink from said ink supply portion to said ink receiving port; and a support substrate for supporting said base plate and for fixing said ink supply member, said ink supply portion including a distal portion with said ink supply port, a base portion connected to said ink supply member, and a neck portion connecting said distal portion and said base portion, said neck portion having a width tapering outwardly from said distal portion to said base portion, wherein said ink supply portion is pressed on said ink receiving port to connect said ink supply port with said ink receiving port and said ceiling plate with said base plate to form said ink passage.

2. An ink jet cartridge as claimed in claim 1, wherein said ink supply member is molded of a deformable material.

3. An ink jet cartridge as claimed in claim 1, wherein said ink supply member includes pressing means for pressing said ceiling plate, said pressing means being molded of a deformable material.

4. An ink jet cartridge as claimed in claim 1, wherein said ink supply member includes at least a pair of foot portions extending therefrom in a direction of a thickness of an assembly of said ceiling plate and said base plate connected to each other and an engagement portion disposed at a foremost end of each of said foot portions for holding said assembly of said ceiling plate and said base plate while maintaining a predetermined thickness of said assembly.

5. An ink jet cartridge as claimed in claim 1, wherein each of said discharge energy generating elements is an element for generating thermal energy for inducing film boiling of the ink to be discharged.

6. An ink jet cartridge as claimed claim 1, further comprising an ink keeping portion for holding said ink, said ink keeping portion being connected to said ink supply member.

7. An ink jet apparatus comprising:

an ink jet cartridge including:

a ceiling plate having an ink receiving port and a plurality of grooves as an ink passage, said grooves being communicated with said ink receiving port, a base plate having a plurality of discharge energy generating elements for generating sufficient discharge energy to discharge ink, an ink supply member having a cantilevered ink supply portion with an ink supply port connected with said ink receiving port for supplying ink from said ink supply portion to said ink receiving port, and a support substrate for supporting said base plate and for fixing said ink supply member, said ink supply portion including a distal portion with said ink supply port, a base portion connected to said ink supply member, and a neck portion connecting said distal portion and said base portion, said neck portion having a width tapering outwardly from said distal portion to said base portion, wherein said ink supply portion is pressed on said ink receiving port to connect said ink supply port with said ink receiving port and said ceiling plate with said base plate to form said ink passage; and mounting means for removably mounting said ink jet cartridge.

8. An ink jet apparatus as claimed in claim 7, further comprising driving means for driving said ink jet cartridge to move relative to a recording medium, or vice versa, and alternatively, driving the ink jet cartridge and the recording medium to move.

9. An ink jet apparatus as claimed in claim 7, wherein said ink jet cartridge further comprises an ink keeping portion for holding said ink, said ink keeping portion being connected to said ink supply member.

* * * * *

UNITED STATES PATENT AND TRADEMARK OFFICE

CERTIFICATE OF CORRECTION

PATENT NO. : 5,606,352
DATED : February 25, 1997
INVENTOR(S) : Koji Yamakawa, et. al.

It is certified that error appears in the above-indentified patent and that said Letters Patent is hereby corrected as shown below:

On title page, item [54] and col. 1, lines 1-3, title of invention should read as follows:
--INK JET CARTRIDGE HAVING A CANTILEVERED INK SUPPLY MEMBER AND INK JET APPARATUS INCLUDING THE SAME--

Signed and Sealed this

Twenty-ninth Day of July, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,606,352

DATED : February 25, 1997

INVENTOR(S) : KOJI YAMAKAWA, ET AL.

It is certified that error appears in the above-indentified patent and that said Letters Patent is hereby corrected as shown below:

AT [56] References Cited

Insert: --Attorney, Agent, or Firm - Fitzpatrick, Cella, Harper & Scinto--.

COLUMN 7

Line 15, "on" should read --an--; and
Line 26, "jet 13" should read --jet unit 13--.

COLUMN 8

Line 20, "portion" should read --portion is located--.

COLUMN 9

Line 19, "view point" should read --viewpoint--;
Line 26, "coming" should read --coming into--; and
Line 29, "corresponding" should read --corresponding to--.

COLUMN 10

Line 29, "project" should read --projected--.

COLUMN 12

Line 9, "silicon" should read --silicone-- and "line" should read --like--.

UNITED STATES PATENT AND TRADEMARK OFFICE

CERTIFICATE OF CORRECTION

PATENT NO. : 5,606,352

DATED : February 25, 1997

INVENTOR(S) : KOJI YAMAKAWA, ET AL.

It is certified that error appears in the above-indentified patent and that said Letters Patent is hereby corrected as shown below:

COLUMN 14

Line 39, "only" should read --only to--;
Line 48, "motor 13." should read --motor 5013.--; and
Line 63, "seen" should read --seen in--.

COLUMN 15

Line 24, "same" should read --the same--.

COLUMN 17

Line 16, "orifice" should read --ceiling--; and
Line 52, "support" should read --supply--.

Signed and Sealed this

Twenty-third Day of September, 1997

Bruce Lehman

*Attest:*

BRUCE LEHMAN

*Attesting Officer*

*Commissioner of Patents and Trademarks*